US005381121A

United States Patent [19]

Peter et al.

[11] Patent Number: 5,381,121

[45] Date of Patent: Jan. 10, 1995

[54] REMOTE CONTROLLED OVERLOAD PROTECTIVE SWITCH

[75] Inventors: Josef Peter, Altdorf; Peter Meckler, Sengenthal; Fritz Krasser, Altdorf; Gerhard Endner, Nürnberg, all of Germany

[73] Assignee: Ellenberger & Poensgen GmbH, Altdorf, Germany

[21] Appl. No.: 41,216

[22] Filed: Mar. 31, 1993

[30] Foreign Application Priority Data

Mar. 31, 1992 [DE] Germany ..... 9204342[U]
Jun. 15, 1992 [DE] Germany ..... 9208010[U]

[51] Int. Cl.[6] ..... H01H 83/00
[52] U.S. Cl. ..... 335/20; 335/14
[58] Field of Search ..... 335/14, 20, 35

[56] References Cited

U.S. PATENT DOCUMENTS

Re. 32,882 7/1989 Yokoyama et al. .
3,211,955 10/1965 Soos, Jr. .
3,521,127 7/1970 Shand .
3,594,668 7/1971 Clarke et al. .
3,601,562 8/1971 Gryctko .
3,651,436 3/1972 Cooper et al. .
3,706,100 12/1972 Halbeck et al. .
3,706,916 12/1972 Halbeck et al. .
3,863,186 1/1975 Mallonen .
4,317,094 2/1982 Peterson .
4,475,094 10/1984 Grenier et al. .
4,502,033 2/1985 Grenier .

FOREIGN PATENT DOCUMENTS 0099233 1/1984 European Pat. Off. .
0391086 10/1990 European Pat. Off. .
657824 5/1929 France .
645755 5/1937 Germany .
518833 10/1965 Germany .
245200 7/1947 Switzerland .

OTHER PUBLICATIONS

ETZ-A Bd. 86 (1965) H. 11, H. Brugsberg: "Über die Verwendung . . . ".

*Primary Examiner*—Lincoln Donovan
*Attorney, Agent, or Firm*—Spencer, Frank & Schneider

[57] ABSTRACT

A circuit breaker which is remote controllable by an external remote control switch by way of an electronic control unit and an electromagnetic switch drive controlled by the electronic control unit. The switch drive switches the electric circuit by a switch lock, which is latched to it and which, during an overload, is unlatched and opened by way of the release of the bimetal of switch drive and, as a result, interrupts the electric circuit. During bimetal release, an auxiliary switch is actuated, which by way of the electronic control unit turns the remote control switch off and re-latches switch drive with the opened switch lock.

25 Claims, 12 Drawing Sheets

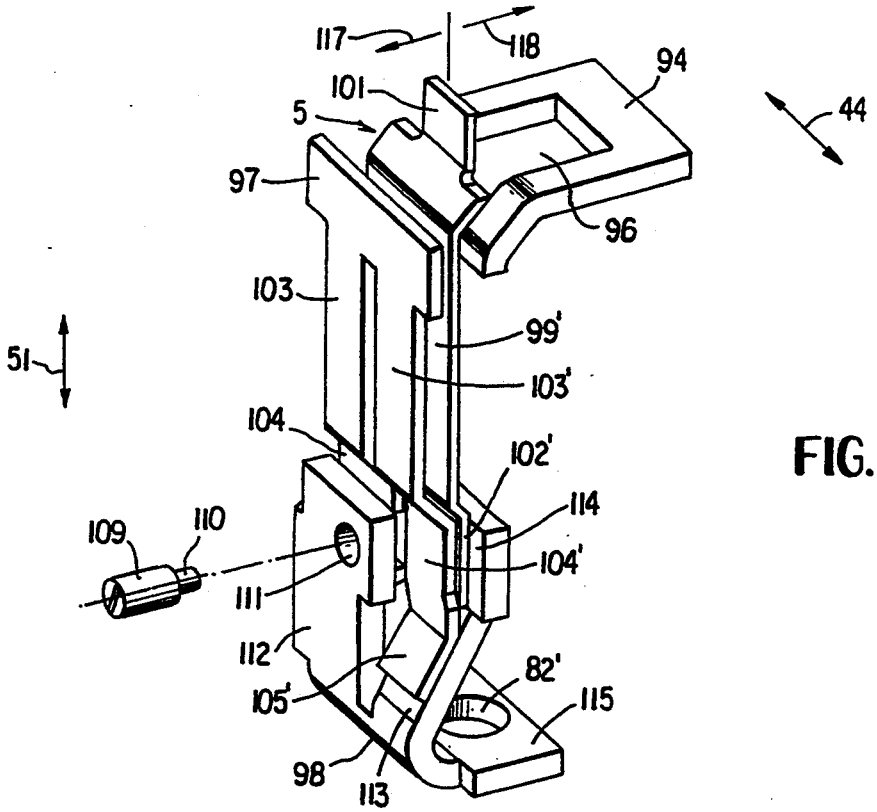
FIG. 10
FIG. 11
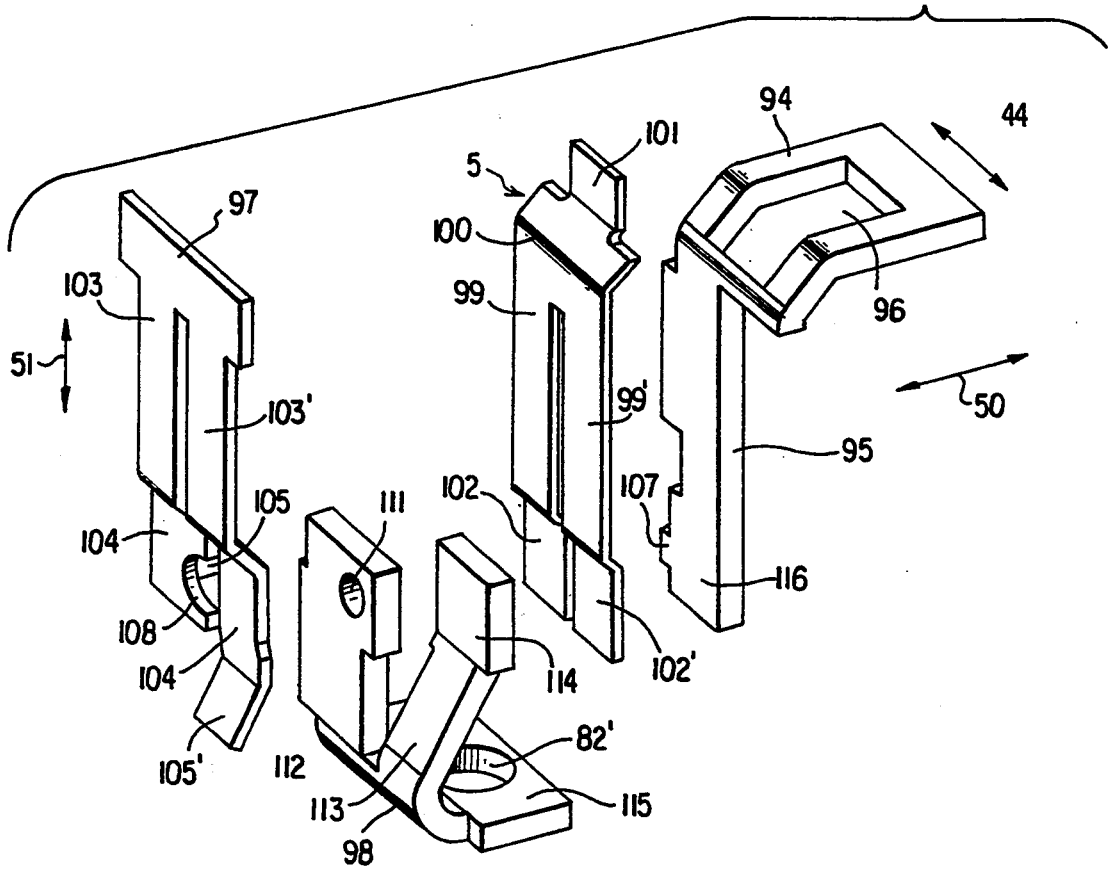

FIG. 16
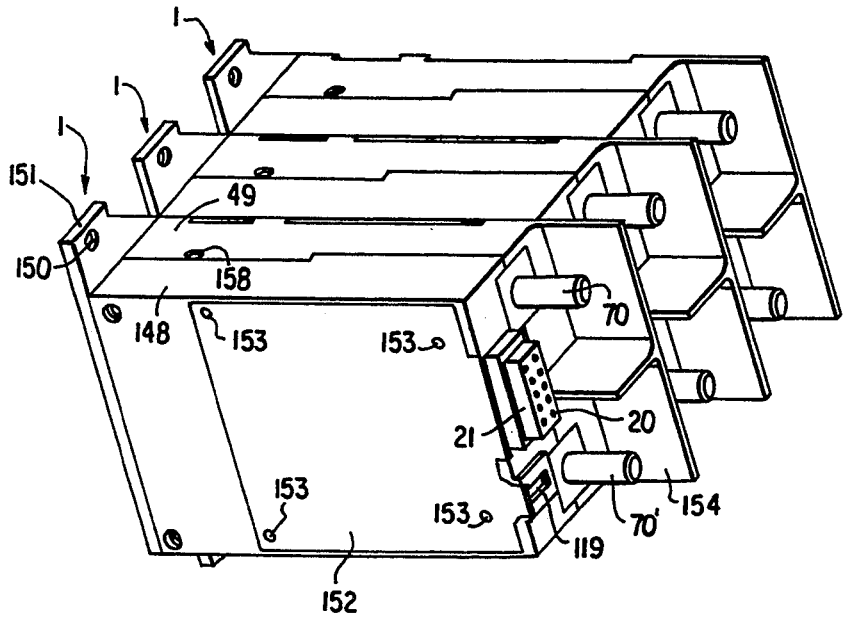
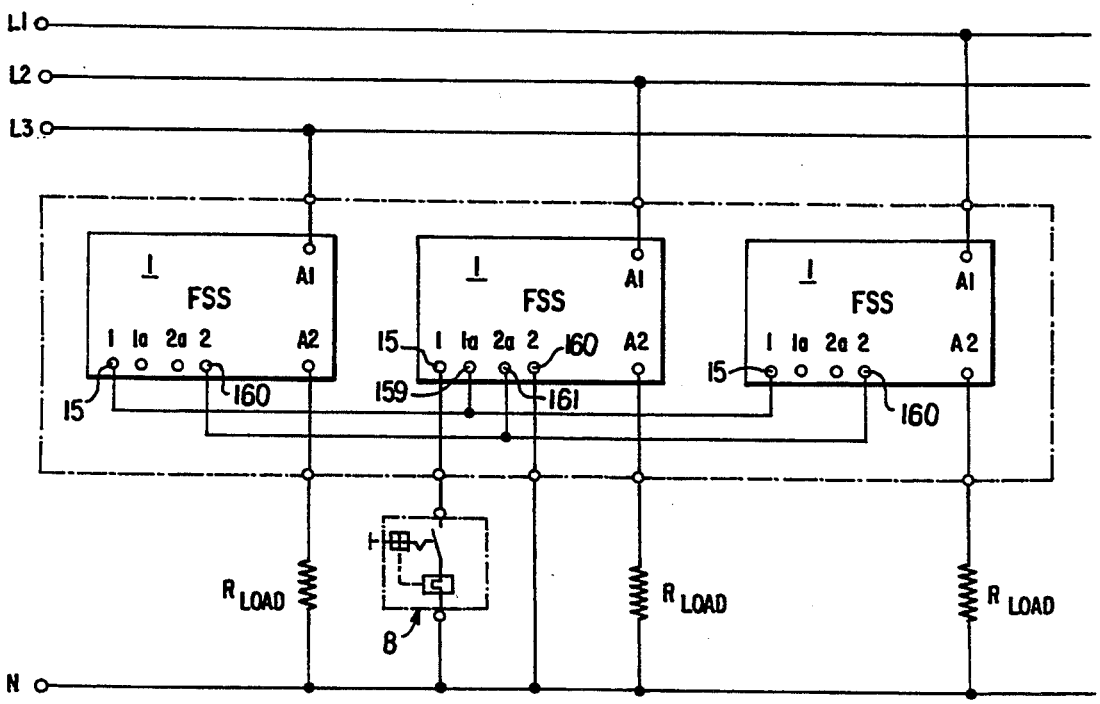
FIG. 17

REMOTE CONTROLLED OVERLOAD PROTECTIVE SWITCH

BACKGROUND OF THE INVENTION

1. Field of the Invention

The present invention relates to a remote control circuit breaker. More particularly, the present invention relates to a remote control circuit breaker which is automatically restored to its initial state after a trip operation.

2. Description of the Related Art

These types of circuit breakers are used, for example, in onboard networks of land vehicles, airplanes or ships. They have increasingly replaced conventional onboard network circuit breakers in which the current lines are guided from the current source to the switching console in the cockpit and from there to the electric load. However, remote control circuit breakers may be arranged directly at the electrical load so that the current lines are guided from the current source directly to the electrical load without the detour over the switching console. Control of the on and off position of the circuit breaker then occurs by an external remote control switch arranged on the switching console. The external remote control switch is connected with the circuit breaker only by control lines.

This type of arrangement for remote control circuit breakers reduces the weight of cables in onboard networks and thus decreases the cost of cabling. Cabling itself is facilitated and results in saving space. The configuration of the switching console is also facilitated, because it now comprises only the control unit, such as, for example, the external remote control switches.

However, the control unit may also be a computer. With the help of the control unit, the circuit breaker may be switched on and off, and the switching status of the contacts may be indicated and tripping due to overload may be indicated.

In known remote controllable circuit breakers, the electronic control unit influencing the switch drive is integrated. Additionally, a thermal release member and a mechanical switch lock for locking and for interrupting the electric circuit are provided. The switch drive and the thermal release member cause the switching movements of the switch lock.

SUMMARY OF THE INVENTION

Known remote control circuit breakers are complicated in their mechanical, electromechanical and/or electronic configuration and are therefore susceptible to malfunction. Taking these drawbacks as a point of departure, it is the object of the invention to configure a remote control circuit breaker in such a way that its few components simplify its configuration and thus reduce its susceptibility to malfunction. The solution is found in the present invention which provides a remote control circuit breaker which is automatically restored to its initial state after a trip operation.

The magnetic system with all its advantages disclosed in German Utility Model Patent DE-GM 1,927,273 and by H. Brungsberg, in "Polarisierte Magnete für Schaltgeräte," (Polarized Magnets for Switching Devices), ETZ-A, Volume 86 (1965), Number 11, Pages 371 et seq., is used as a switch drive. Thus, the control energy required for the switch drive is reduced and the switching sensitivity is increased. Moreover, this switch drive also meets the requirements for EMC (electromagnetic compatibility) of onboard networks. At the same time it supports stable operating settings of the circuit breaker. This switch drive ensures great holding, pushing and pulling forces at low energy consumption for the control. This results in reduced costs and a simultaneous improvement in the performance capability of the circuit breaker. Thus, a simple mechanical configuration makes possible the reliable closing and interruption of the electric circuit. This has a favorable effect on the dimensions of the circuit breaker housing and the costs of the circuit breaker.

An auxiliary switch serves as a connecting link between the electronic control unit and the switch drive, on the one hand, and the mechanism of the circuit breaker, on the other hand, and without additional components, it utilizes the switching movement of the switch lock after bimetal tripping of the circuit breaker to release the external remote control switch. The remote control switch in turn acts on the switch drive of the electronic control unit so that the latter is again locked with the switch lock. This makes it possible to obtain a definite off position of the circuit breaker in a simple automatic sequence.

Coupling of the switch lock to the electronic control unit makes possible a reduction in components for actuating the different operating functions. This is the prerequisite for a simple configuration of the circuit breaker. It reduces cost and increases its reliability.

Several features of the present invention support the orderly and automatic operating sequence of the circuit breaker.

According to one aspect of the invention, the electrical signal of the booster switch can be used for the electronic control unit in order to actuate certain functions of the circuit breaker. The operating sequence is therefore dependent on the switch position of the switch drive. This contributes further to the orderly operating sequence of the circuit breaker. The position of the switch drive may also be indicated in a simple manner, for example, optically or acoustically, by the electric signal of the booster switch.

The booster switch, by its connection to the electronic control unit, frees the circuit breaker in a technologically simple manner for reclosing. Reclosing the switch is thus a function of the switch position of the switch drive, which further facilitates the orderly operating sequence.

A preferred embodiment of the switch lock supports the simple configuration of the circuit breaker and an effective transfer of the force of the pivoting movements of the levers for the switch positions of the switch lock. A dependable opening and closing of the electric circuit is thus ensured.

The mechanical movements of the switch lock are coupled with the switch position of the auxiliary switch. An indication of the operating position of the switch lock is possible without additional components. Stable switch positions of the switch lock ensure the reliable switching of the auxiliary switch and thereby prevent malfunctioning of the circuit breaker.

The corresponding arrangement of the latch lever and the auxiliary switch, makes possible the changeover of the switch at a low expenditure of force. To accomplish this, the sliding and/or pivotal movement of the latch lever are utilized. The auxiliary switch can also be used advantageously as a stop for limiting the pivoting movement.

Another aspect of the invention facilitates switching of the auxiliary switch by the latch lever.

Yet another aspect of the invention relates to a measure for opening the circuit during overload. The bimetal is coupled to the switch position of the auxiliary switch by way of the latch lever and makes possible to indicate bimetal release without additional components. Moreover, unlatching the switch lock during bimetal release ensures the turn-off of the circuit breaker.

The switch rod attached to the switch drive according to claim 10 makes possible a good transfer of force to the switch lock of the circuit breaker.

Still another aspect of the invention relates to a measure for mechanically coupling the switch drive to the switch lock.

The present invention makes possible a very effective transfer of force between the drive lever and the latch lever of the switch lock.

The geometric configuration of the drive lever according to one aspect of the present invention facilitates the changeover of the booster switch.

The user is informed in a simple manner whether the circuit is interrupted or closed.

The components arranged inside the circuit breaker create the condition for a low structural height of the circuit breaker. The circuit breaker thus requires only very little space at the installation site. Moreover, mounting of the individual components within the circuit breaker is facilitated.

A circuit breaker according to the invention is also suitable for measuring values other than overloads. The signal present at the sensor thus replaces the signal of the auxiliary switch during its changeover as a result of the bimetal release, and acts in the same manner on the electronic control unit.

The configuration of the electronic control unit makes possible its easy and spacesaving installation in the circuit breaker. The connecting lines to auxiliary switch, booster switch and switch drive are thus kept short. The electronic control unit can be exchanged in a simple manner if there is a defect. The repair times for the circuit breaker are thus also reduced.

A circuit breaker according to the invention takes into consideration external possibilities for connections to the circuit breaker by way of its connector block, for example for the purpose of measuring. Thus, it is possible to easily check different functions of the circuit breaker.

Other aspects of the invention relate to a simple possibility for signaling the position of the switch lock by way of a display device which can be connected to the connector block.

According to the invention, the remote control switch can also be connected in a simple manner to the electronic control unit. A defective remote control switch can be exchanged without any special expenses for mounting. Moreover, different types of remote control switches may be used without changing the configuration of the circuit breaker.

By using the single-pole circuit breaker according to the invention in numbers corresponding to the number of current phases, it can easily also be employed as a multi-phase circuit breaker, for example, for three-phase current. Prefabrication of the circuit breaker in accordance with the number of phases is eliminated. The structural configuration of a single-pole circuit breaker does not change for different numbers of phases. This means reduced manufacturing and logistic costs.

Another aspect of the invention relates to a further possibility of coupling a plurality of single-pole circuit breakers to form a multi-pole circuit breaker. This makes possible the elimination of all but one connector block.

The invention prevents electrical danger sources, for example, the danger of short circuiting, and it ensures safe operation of the single-pole as well as the multi-pole circuit breaker.

The invention also relates to an advantageous measure for coupling a plurality of single-pole circuit breakers into a multi-pole circuit breaker. This multi-pole circuit breaker makes it possible to eliminate all but one switch drive and it reduces the cost of this circuit breaker.

BRIEF DESCRIPTION OF THE DRAWINGS

The subject matter of the present invention will now be elucidated in greater detail by way of the embodiments shown in the drawings. In the drawings:

FIG. 10 is a perspective view of the overload monitoring device;

FIG. 11 is an exploded view of the overload monitoring device shown in FIG. 10;

FIG. 16 is a perspective view of a triple-pole circuit breaker; and

FIG. 17 is a block circuit diagram showing the electrical coupling of three single-pole circuit breakers to form a triple-pole circuit breaker.

DETAILED DESCRIPTION OF THE PREFERRED EMBODIMENTS

Figure 1:
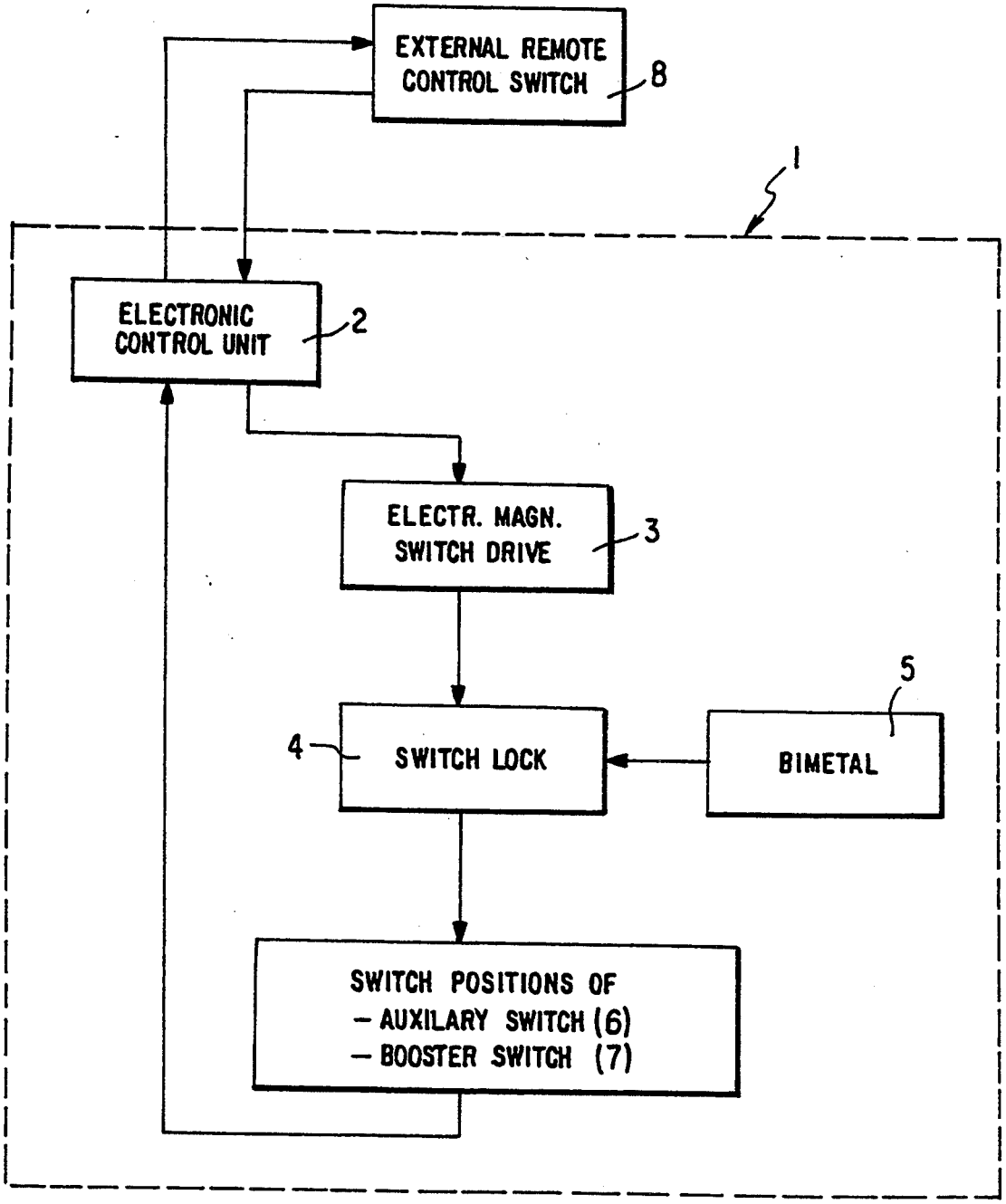
FIG. 1 is a schematic representation of the operating sequence of the circuit breaker.

FIG. 1 is a schematic representation of the components contained in circuit breaker 1 and their mutual coupling. These components are: an electronic control unit 2, an electromagnetic switch drive 3, a switch lock 4, a bimetal 5, an auxiliary switch 6 and booster switch 7. The switch position of the auxiliary switch 6 is unequivocally given by the switch position of the switch lock 4. The switch position of the booster switch 7 is unequivocally given by the position of switch drive 3. Depending on the open or closed position of the switch lock, the circuit in circuit breaker 1 is interrupted (open) or closed. The switch lock 4 is opened either due to the bimetal release or by actuation of the switch drive 3.

During the bimetal release, a reply signal to electronic control unit 2 is given by way of the auxiliary switch 6 in order to turn off an external remote control switch 8 as well. By means of the remote control switch 8, the user is able to remotely control the state of the circuit breaker 1. The remote control switch 8 which is turned off subsequent to the bimetal release, indicates to the user that the circuit breaker 1 is turned off. Additionally, the turned-off remote control switch 8 gives feedback to electronic control unit 2 in order to actuate the switch drive 3 by means of a current pulse. By switching the remote control switch 8 on or off, the user can change the switching position of the switch drive 3. The switching position of the switch drive 3 as a result of the external signal changes the switching state of the circuit breaker 1—provided that switch drive 3 and switch lock 4 are latched.

Figure 2:
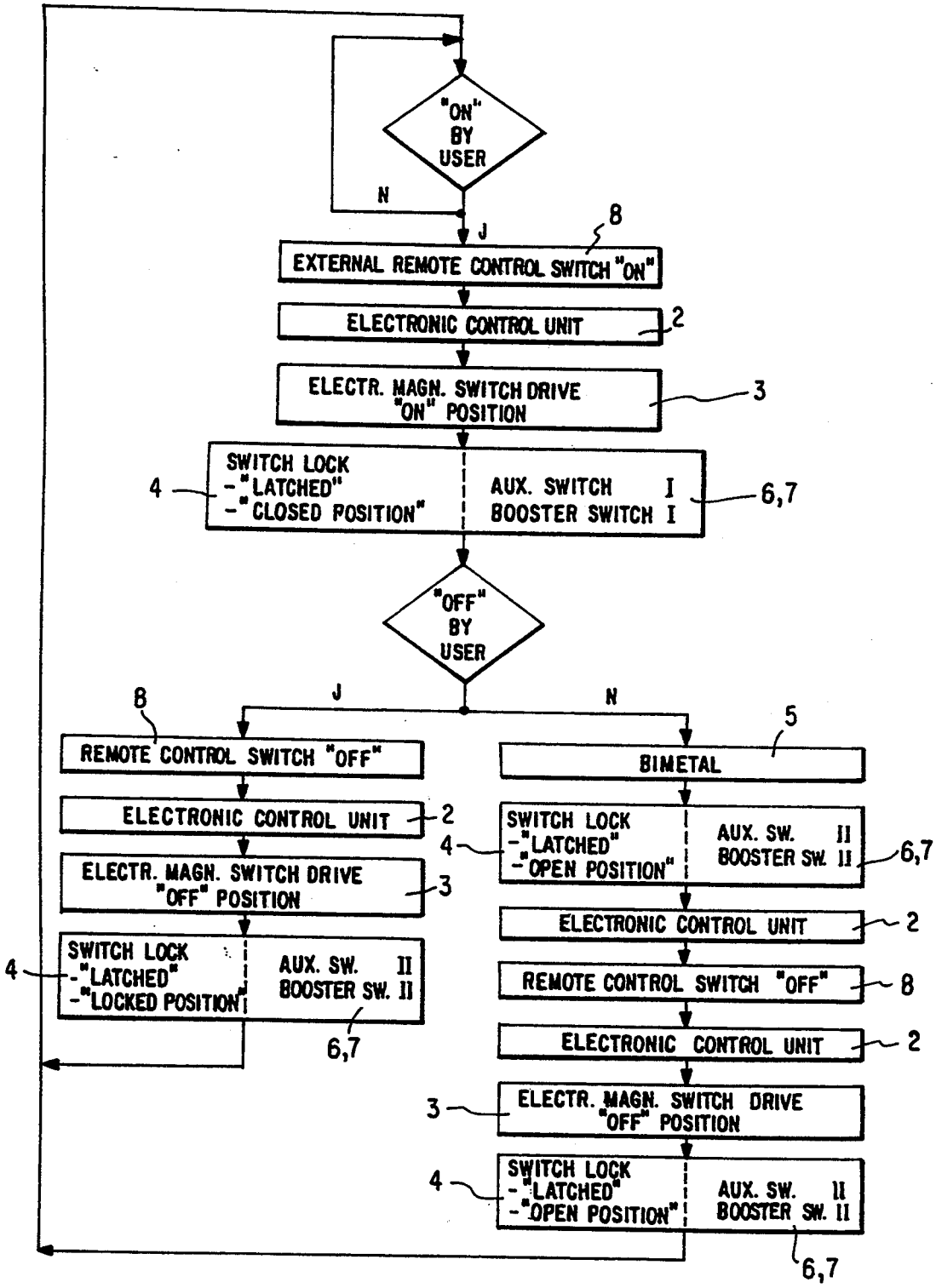
FIG. 2 is a flow diagram of the operating sequence of the circuit breaker.

FIG. 2 shows the operating sequence of the circuit breaker 1 in more detail. Based on a remote switch 8, which is switched on by the user at step 501, electronic control unit 2 produces a current pulse at 502 in order to move the electromagnetic switch drive 3 to its on position at 503. In this case, the switch drive 3 and the switch lock 4 are latched together so that the switch lock 4 is moved to its closing position at 504. This results in the electric circuit being closed. If the switch lock 4 is closed, the auxiliary switch 6 is in switching position I. During the on position of switch drive 3, the booster switch 7 is in switching position I. The electric circuit can now be interrupted either by way of bimetal release or by the user by way of the remote control switch 8.

During the bimetal release at 510, bimetal 5 charges switch lock 4 in order to unlatch the latter from switch drive 3 and to move it to its opening position at 511. In the opening position of switch lock 4, the electric circuit is interrupted. In this case, switch lock 4 switches the auxiliary switch 6. It is therefore in switch position II. During this process, the switch drive 3 is not operated, so that the booster switch 7 continues to remain in switching position I. The new switch position of auxiliary switch 6 effects a signal over electronic control unit 2 at 512 to switch off the remote control switch 8 at 513. The turned-off remote control switch 8 in turn effects a current pulse in electronic control unit 2 at 514 in order to move the switch drive 3 to its off position also at 515. After reaching its off position, the switch drive 3 is again latched to the switch lock 4 which continues to remain in its opening position at 516. In its off position, switch drive 3 switches booster switch 7 so that the latter is now in switching position II. The switching position of the switch lock 4 remains unchanged so that the auxiliary switch 6 continues to remain in switching position II. The new combination of switching positions of auxiliary switch 6 and booster switch 7 enables the user to switch the circuit breaker 1 on again by way of remote control switch 8 at 500. This automatic action sequence results in the same initial position for switching on the circuit breaker 1 as the user obtains it when the circuit breaker 1 is switched off externally.

If the circuit breaker 1 is turned off externally by the user at 505, the remote control switch 8 is turned off first. Thereupon, electronic control unit 2 generates the already-mentioned current pulse at 507 in order to move the switch drive 3 from its on position at 508 to its off position. Since switch drive 3 and switch lock 4 are latched to one another, switch lock 4 is moved to its opening position at 509. Auxiliary switch 6 and booster switch 7 are therefore each in switching position II. This combination of switching positions of auxiliary switch 6 and booster switch 7, which was already mentioned, frees the circuit breaker 1 to be turned on again by the user by means of the external remote control switch 8 at 500.

Figure 3:
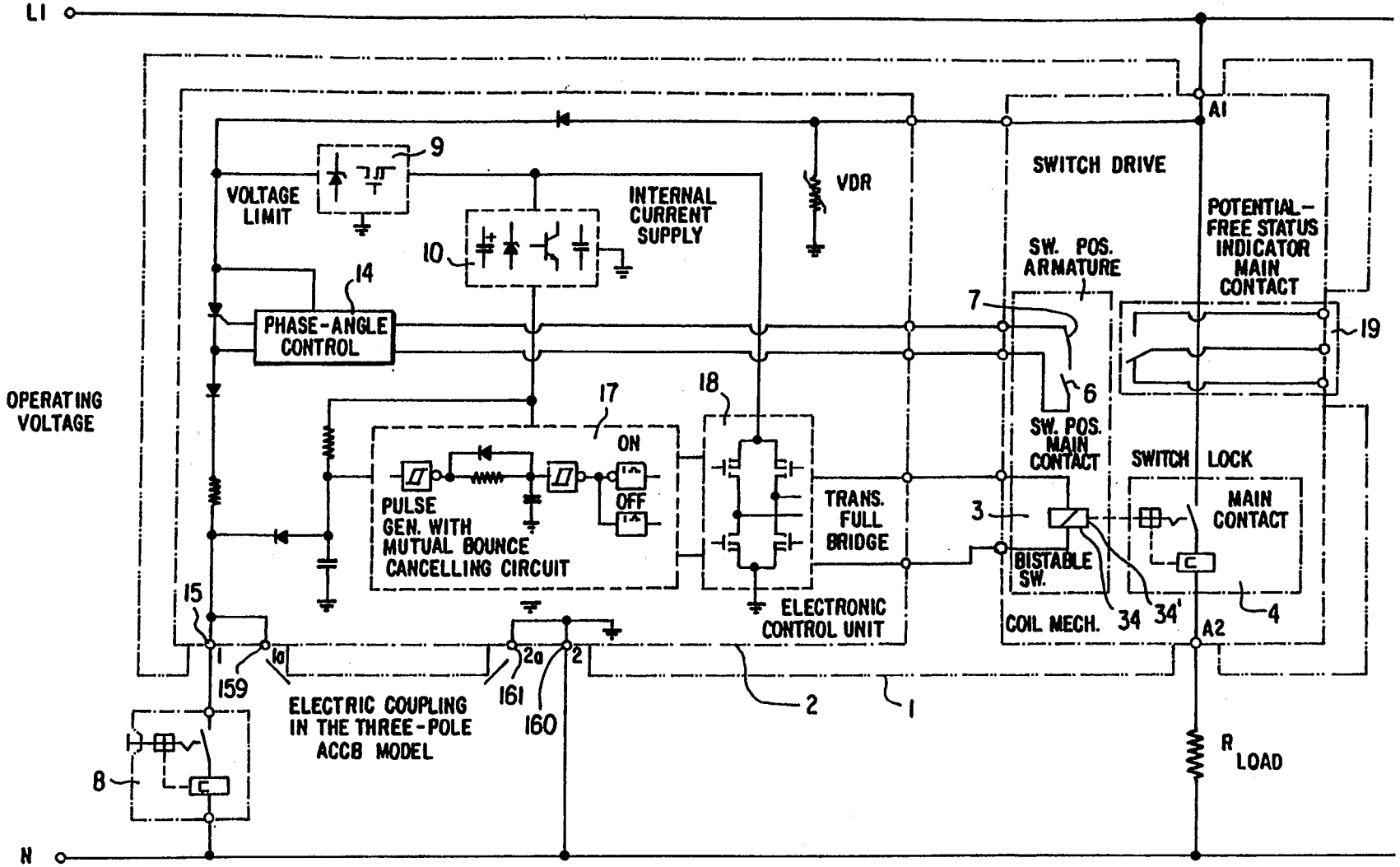
FIG. 3 is a block circuit diagram showing the coupling between the mechanical portion and the electronic control unit of a single-pole circuit breaker.
Figure 15:
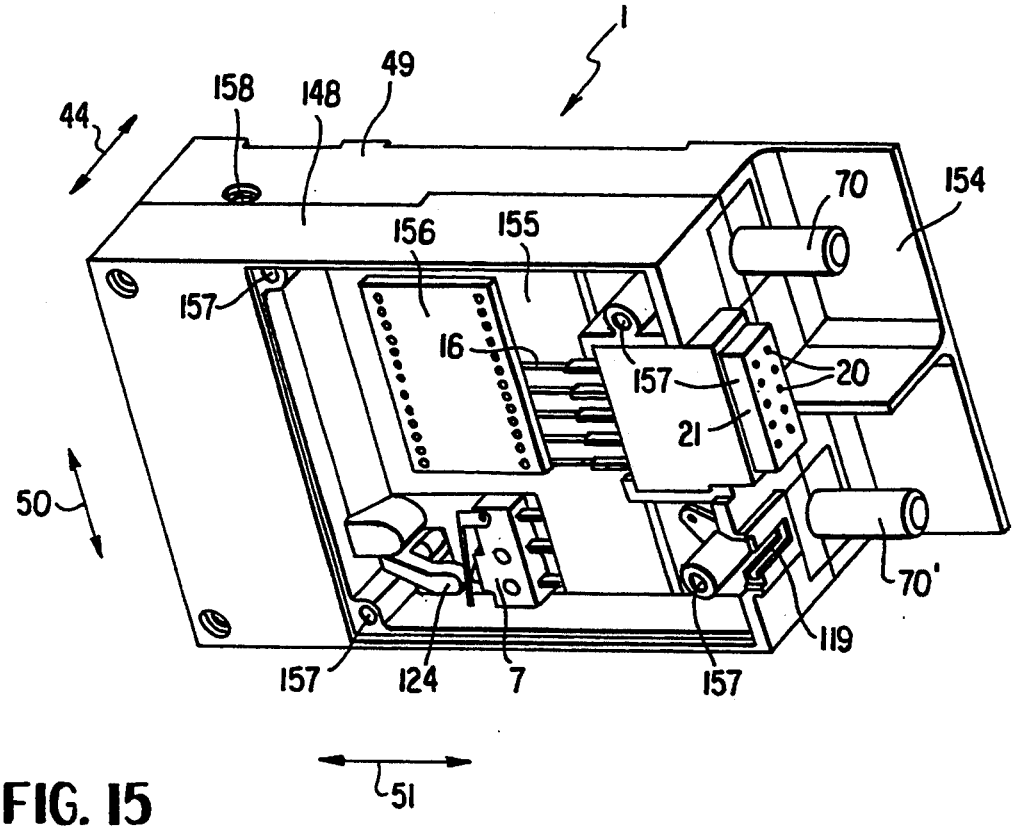
FIG. 15 is a perspective view of a single-pole circuit breaker, including a view of the electronic control unit arranged in the circuit breaker.

The internal electronic control unit 2 of the single pole circuit breaker is elucidated by the block circuit diagram in FIG. 3. It is configured both for direct voltage (for example, 28 volts) and alternating voltage (for example, 115 volts). This is accomplished by a voltage limiter 9 and an internal current supply 10. Booster switch 7 is coupled to the switching position of a drive lever 11 (FIG. 6) which is connected to switch drive 3. Auxiliary switch 6 is coupled with the switching position of a contact lever 12 by way of a latch lever 13. The auxiliary switch 6 and booster switch 7 are connected by way of signal lines to inputs of a phase-angle control 14 within electronic control unit 2. The outputs of the phase-angle control 14 are connected to the remote control switch 8 by way of an input 15 identified by terminal "1" in electronic control unit 2. Input 15 is connected to a connecting line 16 (FIG. 15). The remote control switch 8 is arranged, for example, in the cockpit of an airplane.

The "bistable switch coil" in the block circuit diagram corresponds to switch drive 3. Switch drive 3 receives its control energy by way of a pulse generator 17 and a transistor full bridge 18 which is connected to its output.

A status indicator 19 indicates the respective switch position of contact lever 12 as part of the switch lock 4. A micro-switch serves the purpose of status indicator 19. In the plane of the drawing of FIG. 6 to FIG. 8, it is arranged behind auxiliary switch 6, and therefore it is not shown there. Just as the auxiliary switch 6, the status indicator 19 is switched by means of the latch lever 13. The status indicator 19 is connected to three connecting lines 16 (FIG. 15). A display device may be connected to status indicator 19 by means of the connector sockets 20 of a connector block 21. This makes it possible, for example, to indicate optically or acoustically whether the circuit is open or closed.

Electronic control unit 2 reacts to an exterior switching signal (remote control switch 8) and to an interior switching signal. The interior switching signal is triggered by bimetal 5 or by a sensor. A combination of sensor and bimetal 5 is also conceivable. In this case, the sensor is electrically connected in parallel with the auxiliary switch 6.

Figure 6:
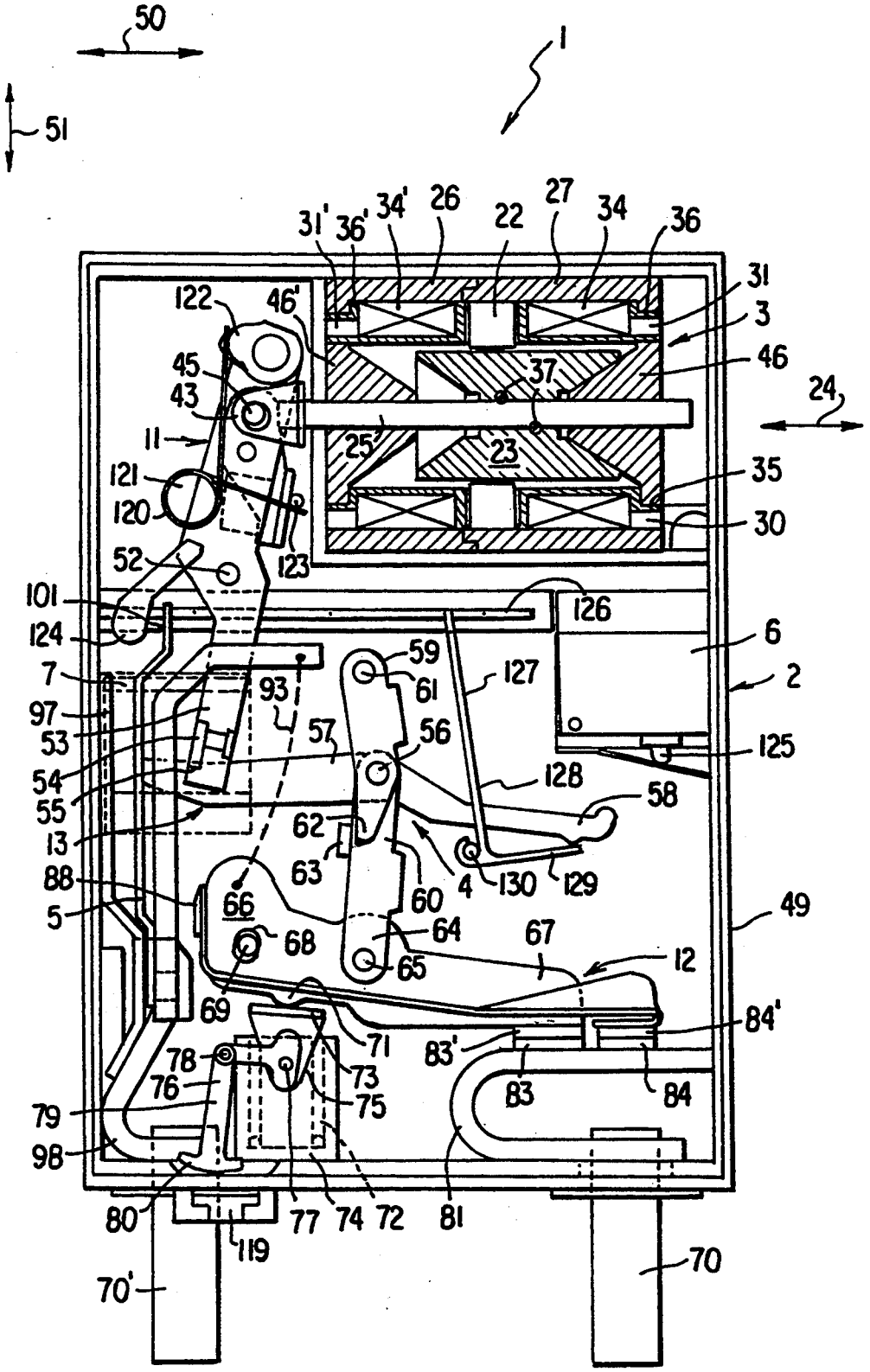
FIG. 6 is a plan view of an open, single-pole circuit breaker with the drive lever in the on position and the contact lever in its contact position.
Figure 7:
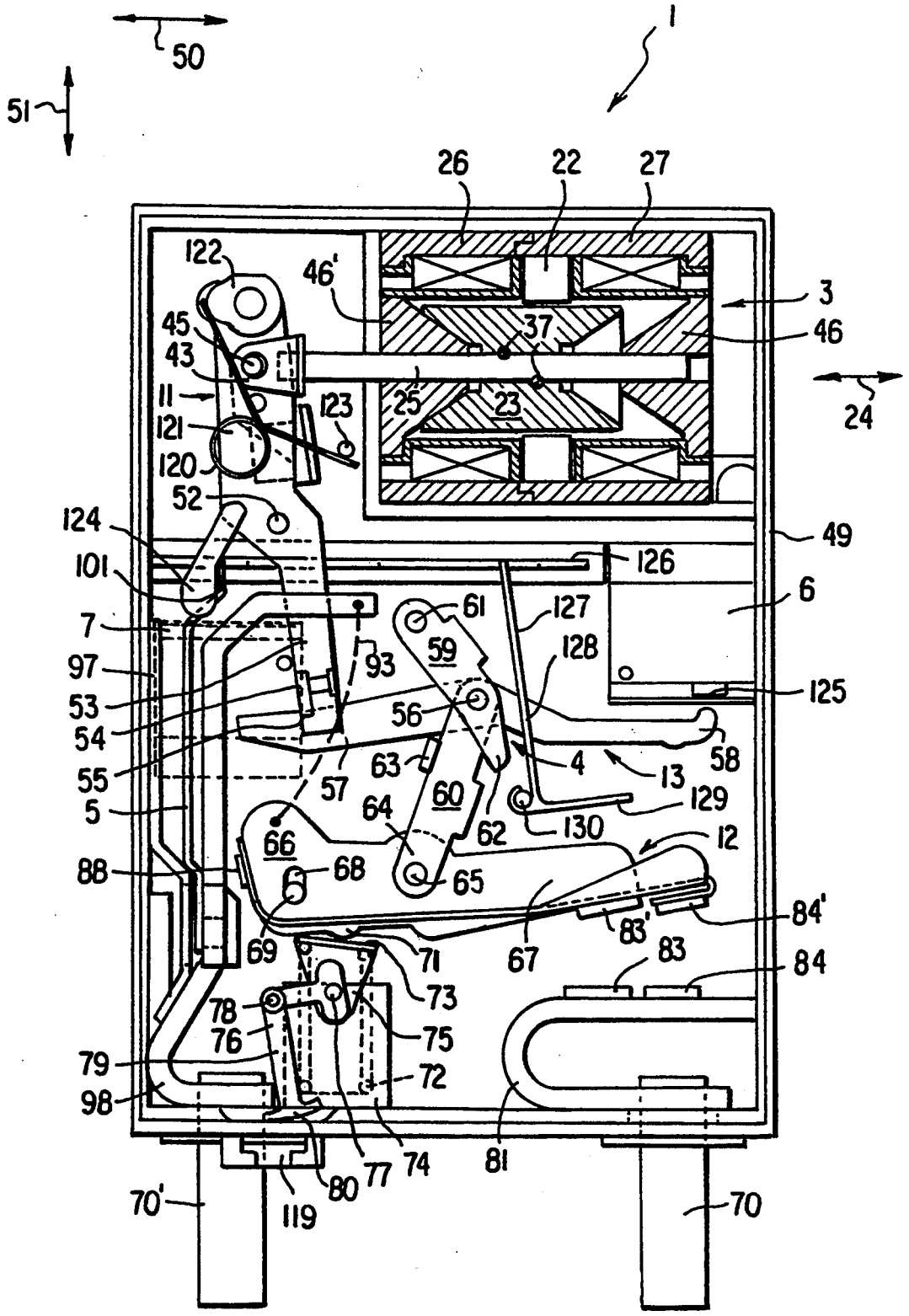
FIG. 7 is a plan view of the opened, single-pole circuit breaker with the drive lever in its off position and the contact lever in its off position.

Remote control switch 8, for example, is turned on. As a result, electronic control unit 2 receives an exterior switching signal at input 15. The exterior switching signal produces a current pulse lasting approximately 30 ms for the electromagnetic switch drive 3 by way of pulse generator 17 and transistor full bridge 18. The drive lever 11 is pivoted into its on position; the contact lever 12 reaches its contact position (FIG. 6). If the remote control switch 8 is turned off, switch drive 3 receives an opposite current pulse which also lasts approximately 30 ms. Drive lever 11 and contact lever 12 are moved to their off position (FIG. 7).

Figure 8:
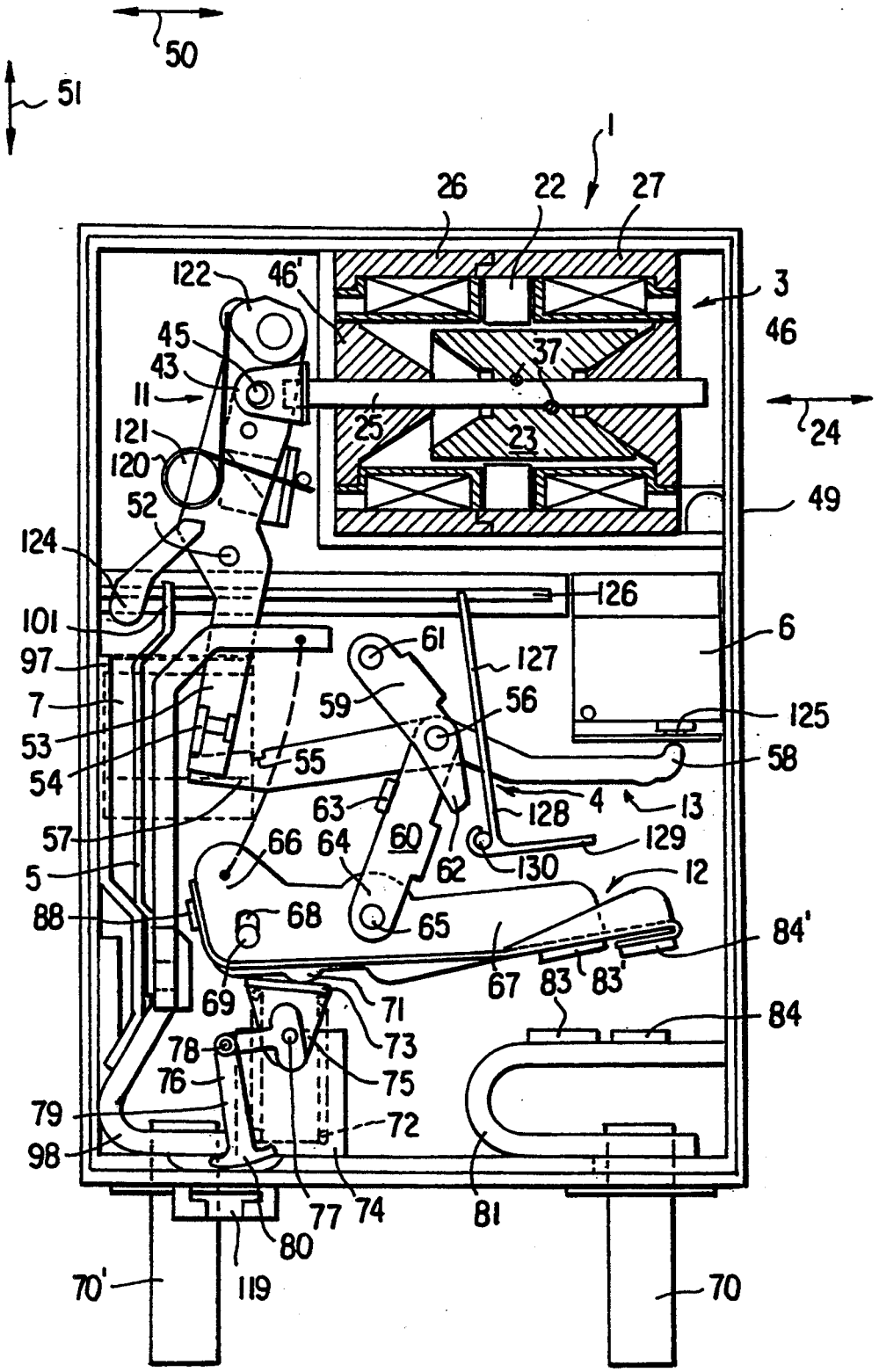
FIG. 8 is a plan view of the opened, single-pole circuit breaker with the drive lever in the on position and the contact lever in its off position.

If the circuit breaker 1 is tripped due to overload (FIG. 8), the combination of switch positions of auxiliary switch 6 and booster switch 7 causes a current to flow through remote control switch 8 by way of phase-angle control 14. This current is approximately a multiple of the rated current of remote control switch 8, which acts as overload circuit breaker. During bimetal release, the drive lever 11 is still in its on position (FIG. 8). However, the current flowing through the remote control switch 8 brings about its release. The circuit within the remote control switch is thus interrupted. Then, an electrical signal is present at the input 15 of electronic control unit 2, which causes switch drive 3 to receive a current pulse by way of pulse generator 17. The drive lever 11 is pivoted to its off position (FIG. 7) and switches the booster switch 7. The new combination of switching positions of the auxiliary switch 6 and booster switch 7 brings about by way of phase-angle control 14 that signals are no longer present at pulse generator 17. As soon as the remote control switch 8 is switched on again, switch drive 3 again receives a current pulse again to move drive lever 11 into its on position (FIG. 6).

Figure 4:
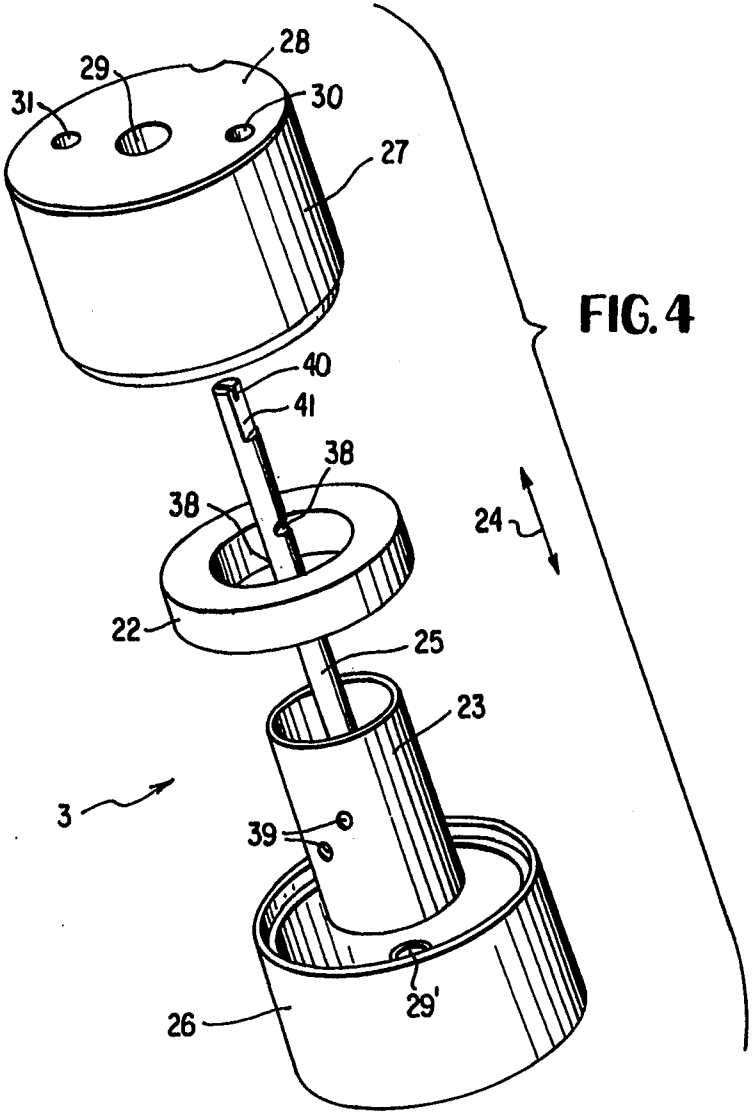
FIG. 4 is an exploded view of the electromagnetic switch drive.

FIG. 4 shows the electromagnetic switch drive 3 in a disassembled state. The principal configuration and function of this type of switch drive 3 are apparent from the abovementioned publications.

Switch drive 3 essentially comprises an annular permanent magnet 22, a hollow cylindrical armature 23, a switching rod 25, which passes through armature 23 in axial direction 24 and two housing halves. In order to increase the magnetic force, high quality permanent magnets 22 are used. To this end, the permanent magnet 22 is made, for example, of an alloy of cobalt and rare earths.

Figure 5:
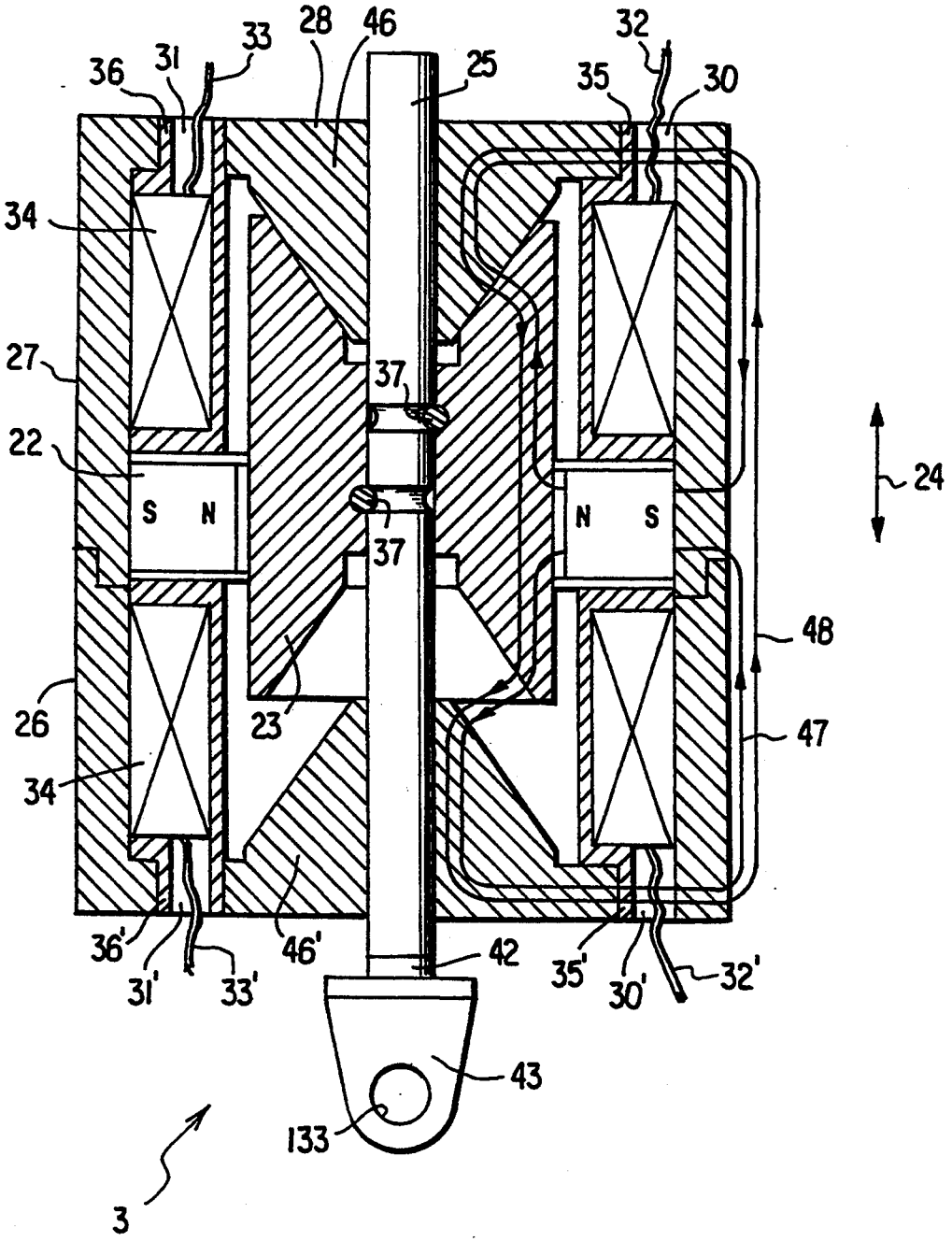
FIG. 5 is a sectional view of the electromagnetic switch drive in the final mounted state.

The two halves of the housing are the cylindrical pot bottom 26 and the likewise cylindrical pot cover 27. The annular end faces of the pot bottom 26 and top cover 27 facing each other are locked to one another in the final mounted state (FIG. 5). The circular exterior surface 28 of the pot cover 27 contains a central bore 29 for guiding the rod and two bores 30, 31 for stranded wires.

The annular exterior surface 28 is manufactured in one piece with the remaining region of the pot cover 27. This avoids air gaps so that the effect of the magnetic force is improved. The same applies to pot bottom 26.

In the region of the pot bottom 26 in FIG. 4, only rod guiding bore 29' is shown. In the final mounted state of the actuating drive 3, switching rod 25 passes through rod guiding bores 29 and 29'. In stranded wire bores 30, 31 of the pot cover 27, as well as in the analogously configured stranded wire bores 30', 31' of the pot bottom 26 shown in FIG. 5, stranded connecting wires 32, 32', 33, 33' are guided by coils 34, 34'. Coil 34 rests in pot cover 27, while coil 34' rests in pot bottom 26. In order to be able to insert coil 34 into pot cover 27, the surface of pot cover 27 lying opposite the exterior surface 28 in axial direction 24 is completely perforated. Insulating elements 35, 35', 36, 36' in the region of the coils 34, 34' additionally insulate connecting stranded wires 32, 32', 33, 33.'

Figure 13:
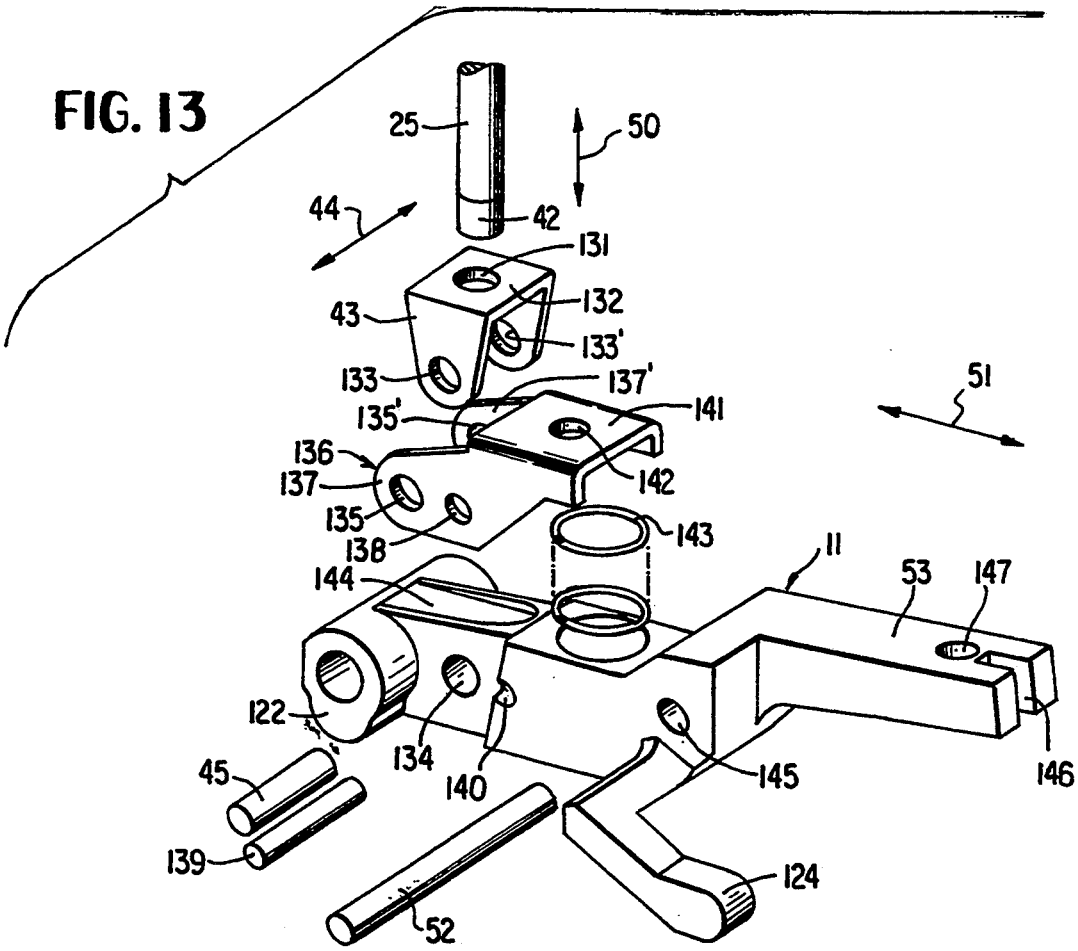
FIG. 13 is an exploded view of the drive lever and the components required for the switching movements of the drive lever.

Armature 23 is fixed to switching rod 25 by means of two fixing pins 37 (FIG. 5). Fixing pins 37 engage in a form-locking manner in two grooves 38 (FIG. 4) which are shaped onto the switching rod 25 and in corresponding pin bores 39 of armature 23. In the end region of the switching rod 25 facing pot cover 27, an adjustment slot 40 is shaped into the top cover to extend in axial direction 24. Adjustment slot 40 extends transversely to axial direction 24 corresponding to the diameter of the switching rod 25. For the purpose of making an adjustment, the switching rod 25 can be simply rotated mechanically by means of adjustment slot 40. The flattened face 41 also serves to transfer the setting torque. The end region of switching rod 25 facing the pot bottom 26 is configured as a rod thread 42 (FIG. 5) and is screwed to a coupling member 43. Coupling member 43, just as the drive lever 11 (FIG. 6), contains a bore which is penetrated by a coupling shaft 45 that extends in depth direction 44 (FIG. 13). The configuration of the drive lever 11 and the parts connected with it is explained in more detail below (FIG. 13).

A truncated cone 46, directed toward the interior, is shaped in one piece to pot cover 27. The truncated cone 46 tapers in the direction of the opposite pot bottom 26 and in its center it is penetrated in the axial direction 24 by rod guiding bore 29. On its end face facing the truncated cone 46, the armature 23 is provided with a conical recess matching armature 23. The same applies to the truncated cone 46' of pot bottom 26 and the end face of armature 23 facing it.

Conical recesses and elevations enlarge the surfaces of the poles between armature 23 and pot cover 27 and pot bottom 26, respectively, thereby increasing the effect of the magnetic force. Since pot bottom 26 and pot cover 27 are made of magnetic material, the magnetic circuit inside the switch drive 3 is closed and is magnetically completely sealed off from the exterior. No leakage occurs toward the exterior, which is why switch drive 3 meets the requirements for electromagnetic compatibility (EMC) when the circuit breaker 1 is used in onboard networks.

Permanent magnet 22 is radially magnetized (FIG. 5) with the south pole facing pot cover 27 and the north pole facing armature 23. The direction of the magnetic field produced by the permanent magnet 22 corresponds to the direction of the arrow 47. Coils 34, 34' are connected in series. Coils 34, 34', through which current flows, also produce a magnetic field. Its direction corresponds in FIG. 5 to the direction of the arrow 48. In FIG. 5, both directions of magnetic flux in the region of the armature 23, which contacts truncated cone 46, are in the opposite direction. In the region of the truncated cone 46' these two directions of magnetic flux are in the same direction. The magnetic force in the region of truncated cone 46' increases if the current in coils 34, 34' flows in the corresponding direction, while it decreases in the region of truncated cone 46 until armature 23 is moved in the axial direction 24 toward truncated cone 46'. If the direction of the current in coils 34, 34' is the reverse, armature 23 is moved in the opposite direction in the axial direction 24.

Figure 14:
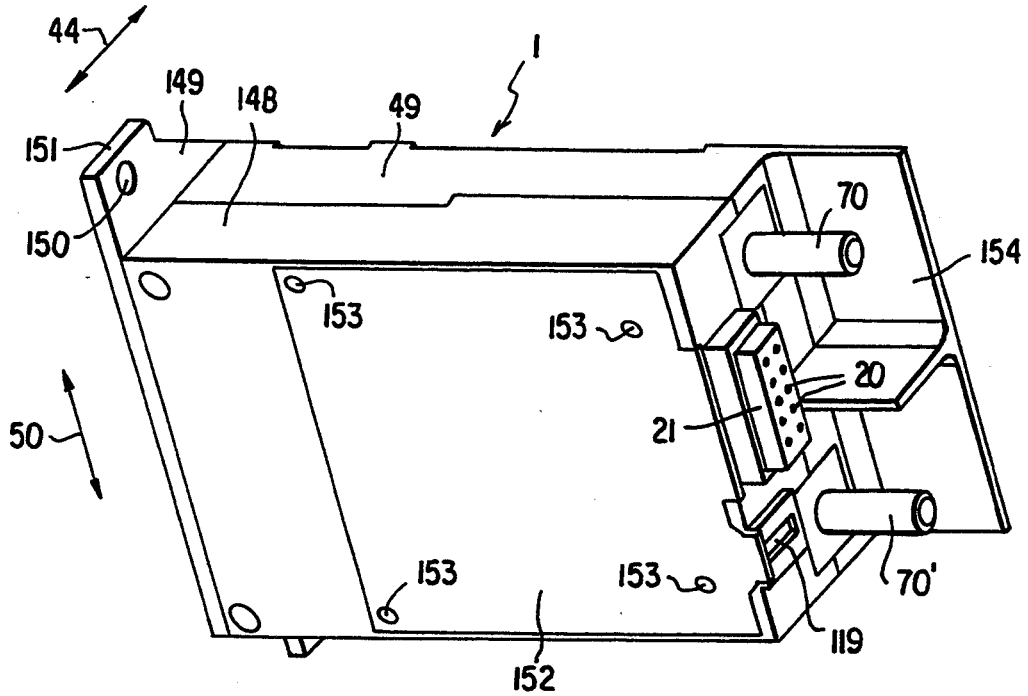
FIG. 14 is a perspective view of the single-pole circuit breaker.

The switch drive 3 is disposed in a housing base 49 (FIG. 6). With respect to its essential operating parts, it is a symmetrical component with its axis of symmetry extending in the axial direction 24. The axial direction 24 (FIG. 6) extends parallel to a transverse direction 50 (FIG. 14).

Drive lever 11 extends essentially in a longitudinal direction 51 perpendicular to depth direction 44 and perpendicular to transverse direction 50. It is mounted to be pivoted by means of a drive lever axis 52 that is fixed to the housing and extends in depth direction 44. It should be mentioned here that the pivot axes of all levers in the switching mechanism extend in depth direction 44 and are therefore arranged vertically to the direction of the movement plane of the levers. This is a prerequisite for the small structural height of circuit breaker 1. The drive lever 11 is a dual-armed lever, whose arms are offset with respect to one another in the transverse direction 50. The arm of the drive lever 11 facing away from the switch rod 25 forms the latch end 53 of the former. A latch plate 54 is fit into latch end 53 and is connected with it. The latch plate 54 form-lockingly engages in a notch 55 in latch lever 13 in the manner of the blade in a knife-edge bearing. The dual-arm latch lever 13 is pivotally mounted on a toggle lever axis 56. Latch lever 13 comprises a latch arm 57, which faces drive lever 11, and a switching arm 58. The ends of both lever arms of the latch lever 13 are offset in relation to one another in the longitudinal direction 51. Latch lever 13 extends essentially in the transverse direction 50. The toggle lever axis 56 also passes through the bores of two levers 59 and 60.

The two levers 59, 60 form a toggle lever with the toggle joint in the region of the toggle lever axis 56. Levers 59, 60, contact lever 12 and latch lever 13 form the switch lock 4.

Levers 59, 60 are arranged approximately in longitudinal direction 51. The end of lever 59 facing away from the toggle lever axis 56 is mounted to a lever axis 61 which is fixed to the housing. The end of the lever 59 in the region of the toggle lever axis 56 is conically elongated in the longitudinal direction 51. It forms a limiting catch 62. The limiting catch 62 extends so far into a region of the lever 60 that it is able to interact with the catch abutment 63 arranged on the surface of the lever 60 facing drive lever 11. In FIG. 6 the catch abutment 63 has a rectangular shape. Limiting catch 62 and catch abutment 63 limit the mutual pivoting range of levers 59, 60.

The end of lever 60 which faces contact lever 12, comprises the contact lever end 64 of the toggle lever. Contact lever 12 and contact lever end 64 of the toggle lever are connected to one another by way of a pivot bearing 65. To accomplish this, an axis passes through a bore of contact lever end 64 and contact lever 12. Contact lever 12 extends essentially in the transverse direction 50. With respect to the pivoting bearing 65, contact lever 12 is a dual-armed lever having a bearing end 66 which faces the drive lever 11 and a contact end 67 facing away from it. In the region of bearing end 66, the contact lever 12 has a longitudinal slot 68. It is penetrated by a contact lever bearing 69 which is fixed to the housing. The longitudinal slot 68 allows a sliding movement of the contact lever 12 while the latter is being pivoted. With respect to the contact lever bearing 69, contact lever 12 forms a single armed lever. In the longitudinal direction 51, bearing end 66 and contact end 67 are offset in relation to one another. In FIG. 6 the surface of contact lever 12 facing the two connecting pins 70, 70', extends in the region of its contact end 67 parallel to the transverse direction 50. By contrast, in the region of the bearing end 66 this region is sloped in the direction of drive lever 11. An approximately semicircular contact lever knob 71 is shaped to this sloped surface. With its convex side it faces connecting pin 70, 70'. The convex side of the contact lever knob 71 contacts a pressure plate 73 connected to a contact compression spring 72. Contact compression spring 72 rests in a form-locking manner in a hollow cylindrical spring housing 74 shaped to housing bottom 49. Contact compression spring 72 produces a pressure force in the longitudinal direction 51.

A jaw 75 extends conically in the direction of connecting pin 70, 70', perpendicularly connected to the pressure plate 73. The jaw 75 is connected in one piece to pressure plate 73 and in a pivoting point to an indicator lever 76. The indicator lever 76 itself is pivotally mounted in a pin 78 which is fixed to the housing. The indicator lever 76 comprises two arms which are positioned perpendicular to one another and whose point of intersection corresponds to the center point of pin 78. The longer one of the two arms of the indicator lever 76 is aligned approximately in the longitudinal direction 51. It forms the indicator arm 79 which has a flange-like enlargement at its free end. The flange-like enlargement is like the arc of a circle and extends approximately in transverse direction 50. It gives the indicator arm 79 the configuration of a hammer. The end face of the flange-like enlargement pointing in the longitudinal direction 51 forms an indicator surface 80. It is directed to the opening of the display window 119 which is shaped to the bottom of the housing. An optical display of the operating position of the contact lever 12 is thus possible.

Figure 9:
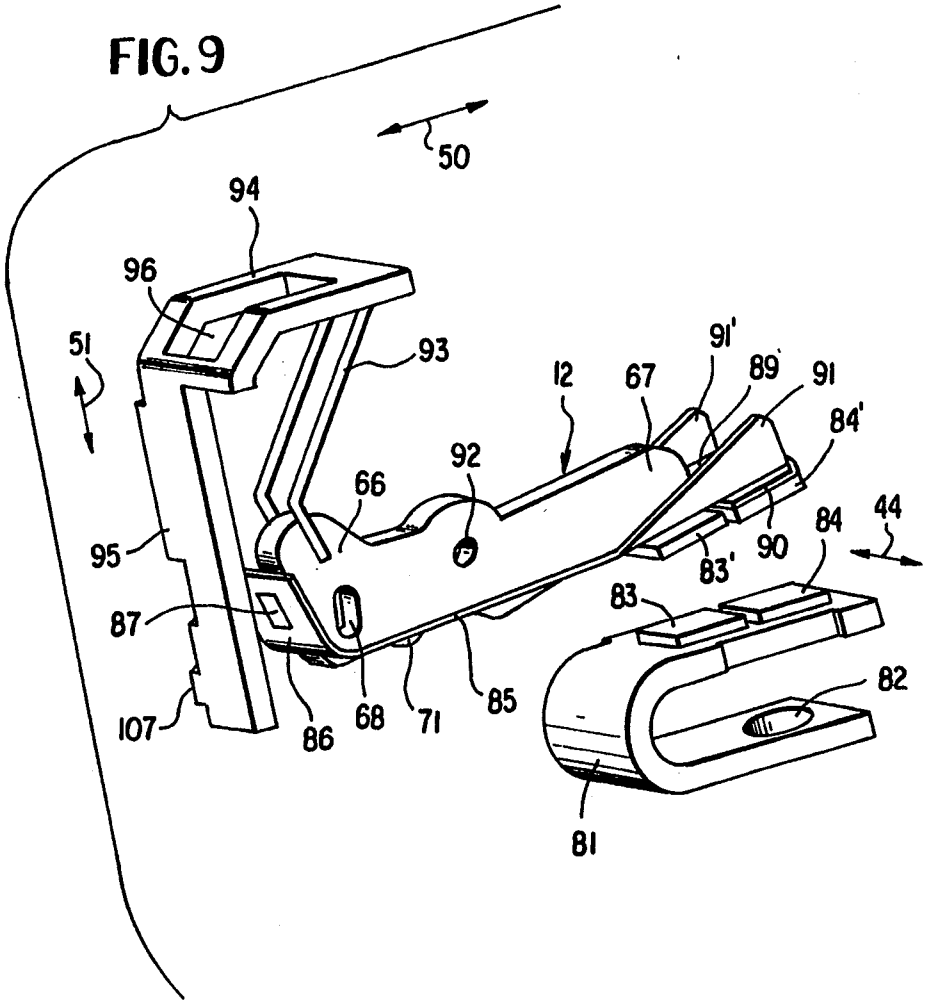
FIG. 9 is a perspective view of the contact lever and parts of the electric circuit.

Further details of the contact lever 12 and its interaction with the electric circuit are explained by way of FIG. 9. The end of connecting pin 70 on the side of the bottom of the housing is connected with a U-shaped current branch 81 in a form-locking manner to electrically contact this current branch 81. Current branch 81 is fastened to an interior housing wall of the circuit breaker 1 by means of connecting pin 70. The two U-legs of the current branch 81 are arranged parallel to the transverse direction 50. The two U-legs have different lengths. In the region of its free end, the shorter U-leg is penetrated by a cylindrical pin opening 82 for a form-locking connection with the connecting pin 70. On the longer U-leg, on the surface facing the contact lever 12, a main contact 83 and a premovement contact 84 are fastened. Main contact 83 and premovement contact 84 are configured in the manner of a plate having a rectangular outline. In the region of the contact end 67 of contact lever 12, a main contact 83' and a premovement contact 84', similar to main contact 83 and premovement contact 84, are arranged. The main contact 83' is shaped to the surface of contact end 67 which faces current branch 81. In the depth direction 44, main contact 83' projects over contact lever 12. Premovement contact 84' is shaped to the free end of a strip-like spring clip 85. Spring clip 85 is fastened with its fastening end 86 to contact lever 12. For this purpose, the fastening end 86 is provided with a rectangular pin opening 87. The pin opening 87 is penetrated by a rivet pin 88 (FIG. 6) which results in the connection between contact lever 12 and spring clip 85. The fastening end 86, in relation to the remaining portion of the spring clip 85 which extends in the transverse direction 50, is bent approximately in the longitudinal direction 51 toward the drive lever 11. The portion of the spring clip 85 extending in approximately the transverse direction 50 is, with the exception of its free end 89, which carries the premovement contact 84', penetrated by a slot.

Contact lever 12 rests in this slot. The dimensions of the slot, which is rectangular when viewed in longitudinal direction 51, are somewhat greater than the width of contact level 12 in depth direction 44 and the length of contact lever 12 in transverse direction 50.

The free end 89 is enlarged by means of a clip extension 90. In relation to free end 89, clip extension 90 is bent 180° in the direction of contact lever 12. On the surface facing the premovement contact 84, clip extension 90 carries premovement contact 84'. Two parallel spring jaws 91, 91' join free end 89 vertically in longitudinal direction 51. They are shaped in one piece to spring clip 85. In the transverse direction 50, they extend over free end 89 into the region of contact end 67 of contact lever 12. Contact end 67 is flanked on both sides by spring jaws 91, 91'. The structural height of the spring jaws in longitudinal direction 51 continually increases, starting from contact end 67 along transverse direction 50 until it drops abruptly in the region of the bend between the free end 89 and clip extension 90.

A bearing bore 92 for the pivot bearing 65 (FIG. 6) is located approximately in the middle of contact lever 12 along transverse direction 50. A contact end of a stranded wire 93 is soldered or welded to each side of bearing end 66. The contact ends of the stranded wire 93 for contact lever 12 form the free ends of two U-legs. The U-base of stranded wire 93 in FIG. 9 is covered by the bus extension 94 of a current bus 95. The covered U-base of stranded wire 93 is also soldered or welded to the bus extension 94. Bus extension 94 is a metal strip having a rectangular bus slot 96 if viewed from the longitudinal direction 51. Bus slot 96 is penetrated by drive lever 11. Drive lever 11 is formed of plastic in order to further effectively insulate the electric circuit from the windings of coils 34, 34'. Bus extension 94 is arranged parallel to transverse direction 50. In a connecting region of current bus 95 which extends parallel in longitudinal direction 51, bus extension 94 is bent 45° in the direction of the connecting pin 70'. Contact bus 95 and bus extension 94 are manufactured in one piece from a metal strip. However, in the region of current bus 95, the metal strip is only half as wide in depth direction 44 as in the region of bus extension 94. On its surface facing away from housing cover 148, the metal strip forming current bus 95 is provided in its finally mounted end position with a plurality of recesses or grooves which are rectangular when viewed from transverse direction 50.

If main contacts 83, 83' and premovement contacts 84, 84' contact one another, the electrical circuit is closed. With the components shown in FIG. 9, the current is supplied, for example, to current branch 81 by way of connecting pin 70 and then it flows through main contacts 83, 83' and premovement contacts 84, 84' into the spring clip 85 and contact lever 12, respectively. From the bearing end 66 of contact lever 12, the current flows by way of stranded wire 93 into current bus 95.

FIG. 9 shows the contact lever 12 in a turn-off position. In this case, spring clip 85 lies against main contact 83' with pre-tension. If the contact lever 12 is brought into its contact position, premovement contacts 84, 84' are thrust together first. Main contacts 83, 83' are thrust together with a slight delay in time. In the contact position of contact lever 12 the spring clip 85 is lifted from main contact 83'. If current is flowing through current branch 81, a division of the current takes place in the region of main contact 83 and premovement contact 84. The division of current depends on the resistance of the individual components. The greatest portion of current flows by way of contact lever 12.

The premovement contacts 84, 84' have good burn-up characteristics and therefore a higher contact resistance. Main contacts 83, 83' have a lower contact resistance but they are more susceptible to stress from electrical arcs. During the movement of contact lever 12 into its turn-off position, main contacts 83, 83' are separated first. Total resistance is temporarily increased due to the resulting electric arc. Premovement contacts 84, 84' are separated from one another with a slight delay in time. Then the main electrical arc develops between the contact region of the premovement contacts 84, 84'. The electrical arc between main contacts 83, 83' is extinguished earlier. The resulting electrical arcs are cooled by metal quenching sheets in order to shorten the quenching times.

The further current path can be elucidated based on the explanations of FIG. 9 with reference to FIG. 10 and FIG. 11. The current flowing through the bus extension 94 and current bus 95 branches into a parallel circuit comprising bimetal 5 and a shunt current path 97. The two partial currents are summed again in the region of a carrier console 98. The carrier console 98 contains a cylindrical pin opening 82' corresponding to current branch 81 (FIG. 9). The pin opening 82' serves for the form-locking and electrically contacting connection to the connecting pin 70' (FIG. 6).

The configuration of the individual parts of the overload monitoring device in FIG. 10 is explained with the help of FIG. 11. What is involved is a bimetal assembly, including a U-shaped bimetal 5. The two bimetal legs 99, 99' are arranged in longitudinal direction 51. The U-base forms the moving end 100 of bimetal 5 and extends in depth direction 44. In its region remote from bimetal legs 99, 99', the moving end 100 is bent 45° in transverse direction 50. This bent-off region extends in a parallel plane to the region of the bus extension 94 which is also bent 45°. The width of bimetal 5 in depth direction 44 is somewhat less than the respective extent of bus extension 94. A bimetal projection 101 follows the region of the moving end 100 which is bent 45°. Viewed in transverse direction 50, bimetal projection 102 is configured rectangularly. It is arranged in a plane parallel to bimetal legs 99, 99'. The extent of bimetal projection 102 is less in depth direction 44 than that of the moving end 100, and the bimetal projection is shaped to the middle of the end of the bent-off region of moving end 100. In the final mounted position of the bimetal assembly, the free ends of bimetal legs 99, 99' are directed toward connecting pin 70'. These free ends are approximately square-shaped contact ends 102, 102'. Contact ends 102, 102' are offset in the direction of the current bus 95 relative to the remaining region of bimetal legs 99, 99'. In the final mounted position current bus 95 covers bimetal leg 99 viewed in transverse direction 50.

Figure 12:
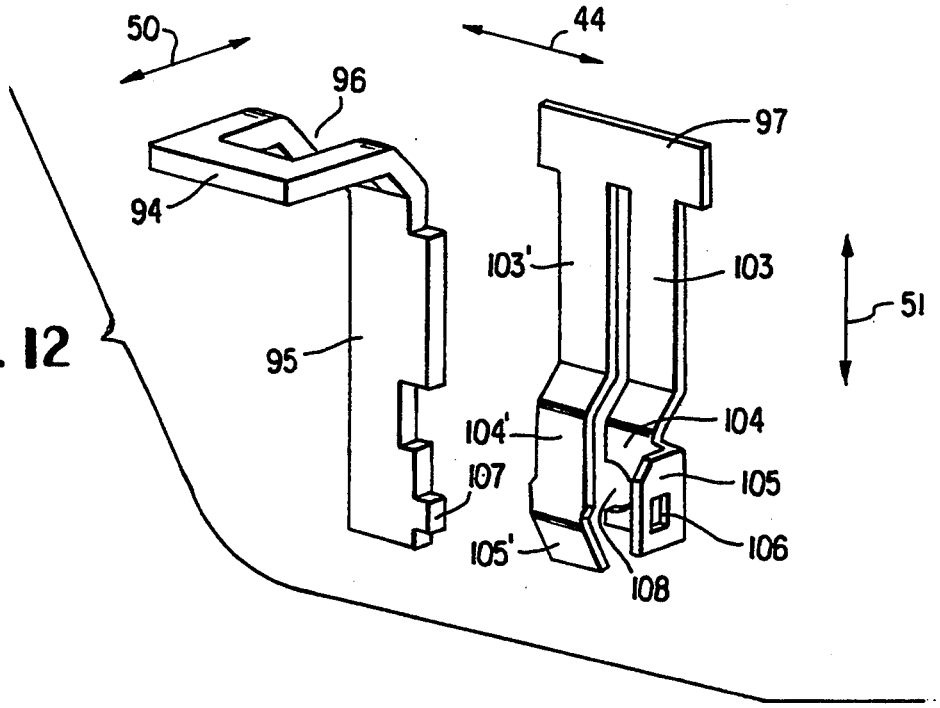
FIG. 12 is a rear view of parts of the overload monitoring device according to FIG. 11.

Shunt current path 97 is also configured in shape of a U. It is arranged in a plane parallel to bimetal 5. The U-base of the shunt current path 97 projects over the two shunt current legs 103, 103' in depth direction 44. Its extent in this direction is somewhat greater than the corresponding extent of bus extension 94. The two shunt current legs 103, 103' and the ends of legs 104, 104' connected to them correspond in outline and arrangement approximately to bimetal legs 99, 99' and their contact ends 102, 102'. However, leg ends 104, 104′ are extended by contact pieces 105, 105′. The leg end 104′ is extended by means of contact piece 105′ approximately in the longitudinal direction 51. However, contact piece 105′ is bent away from bimetal 5. Viewed in the transverse direction 50, contact piece 105′ is approximately square. The leg end 104 is provided with a greater extent in depth direction 44 by comparison with the associated shunt current leg 103. Contact piece 105 is connected to it, bent away at right angles and directed to the current bus 95. Viewed in depth direction 44, the outline of contact piece 105 is essentially rectangular. In its middle region, contact piece 105 is penetrated in depth direction 44 by a rectangular contact opening 106 (FIG. 12). The surface of current bus 95, which, in its final mounted position, faces away from housing cover 148, contains, as already mentioned in FIG. 9, a plurality of grooves and recesses. A contact recess 107 which extends in depth direction 44 is shaped to the region of current bus 95 which faces away from bus extension 94. The shape of the outline of the contact recess conforms to the outline of the contact opening 106 in such a way that in the final mounted state a form-locking connection is established between current bus 95 and contact piece 105.

Leg end 104, in its region facing leg end 104′, is penetrated in transverse direction 50 by a screw opening 108. The shape of its outline corresponds approximately to that of a semi-circle, with its concave side facing leg end 104′. Screw opening 108 makes possible that, in the final mounted state, an adjustment screw 109 with its insulating pin 110 can penetrate leg end 104 without contact and can act on the contact end 102 of bimetal 5. Cylindrical insulating pin 110 is shaped centrally to the end face of adjustment screw 109. The operating direction of adjustment screw 109 corresponds to transverse direction 50. The adjustment screw 109 is mounted in a threaded bore 111. The threaded bore 111 penetrates current-less branch 112 of carrier console 98 in transverse direction 50. In this direction, branch 132 has the outline of a rectangular plate. In the region of the edge of the corner facing shunt current leg 103 and the edge of the corner diagonally opposite from it, branch 112 is recessed rectangularly.

In depth direction 44, next to current-less branch 112, a shunt contact surface 113 is shaped in one piece to the carrier console 98. Viewed in transverse direction 50, the outline of the shunt contact surface 113 is essentially rectangular. While the current-free branch 112 in the final mounted position is arranged parallel to leg end 104 of shunt path 97, the shunt contact surface 113 is bent off in the direction of the current bus 95. The shunt contact surface 113 and contact piece 105′, which in relation to leg end 104′ is also bent off, are arranged in mutually parallel planes. A bimetal contact surface 114, extending parallel to current bus 95 is shaped in one piece to the free end of shunt contact surface 113. Viewed in the transverse direction 50, the bimetal contact surface 114 is square. In depth direction 44, plate-like bimetal contact surface 114 projects over the shunt contact surface 113 on the side facing away from branch 112. Branch 112 and shunt contact surface 113 are connected to one another by way of a base member 115. Base member 115 is rectangular in longitudinal direction 51. Base member 115 is that part of the carrier console 98 with which connecting pin 70′ is electrically connected in the final mounted position. For this purpose base member 115 is penetrated in longitudinal direction 51 by the cylindrical pin opening 82′.

In the final mounted position, the bus end 116 facing away from bus extension 94 is welded to contact end 102 of bimetal 5. Contact recess 107 of the current bus 95 is electrically connected with contact piece 105 of shunt current path 97. Contact end 102′ of bimetal 5 is welded to bimetal contact surface 114. The same applies to contact piece 105′ of shunt current path 97 and shunt current contact surface 113. The facing end faces of contact end 102 and leg end 104 are separated from one another by an air gap. For additional insulation, an insulating disk may be inserted between these two end faces. Contact end 102 of bimetal 5 is pressure charged by means of adjustment screw 109. Bimetal legs 99, 99′ can be biased against one another by adjusting adjustment screw 109. As a result, bimetal 5 is adjusted and a different release sensitivity can be set.

The current flowing according to the explanations of FIG. 9 is divided in the region of bus end 116. One portion flows through bimetal 5 from contact end 102 to contact end 102′. The other component of the current flows through shunt current path 97 from contact piece 105 to contact piece 105′. In the region of the shunt current contact surface 113 of carrier console 98, the two partial currents are summed again. Bimetal 5 is made in such a way that, during an overload, the moving end 100 is deflected in the direction toward shunt current path 97. This corresponds to a deflection side 117 (FIG. 10). The opposite direction along transverse direction 50 corresponds to rear side 118. The thermal deflection movement is supported by an electrodynamic force which acts on bimetal leg 99. Current bus 95 and bimetal leg 99 act as two parallel conductors through which current flows in opposite directions. Such conductors repel each other mutually due to the effect of the electrodynamic force. Shunt current leg 103 and bimetal leg 99 act as two parallel conductors through which current flows in the same direction. Such conductors attract each other due to the effect of the electrodynamic force. The electrodynamically caused deflection movement of bimetal 5 supports the thermal deflection movement of the same, particularly during great overloads. This results in increased release sensitivity of the circuit breaker and decreased release time.

The bimetal assembly shown in FIG. 10 and FIG. 11 is suitable for currents above 50 A. Due to the parallel connected shunt current path 97, a division of the current occurs which makes it possible to decrease the cross section of bimetal 5. Due to the decrease in the cross section, the electrodynamic force can be utilized more effectively.

The operating positions of circuit breaker 1 are elucidated by way of FIG. 6 and FIG. 8. In FIG. 6, contact lever 12 is in its contact position. Main contacts 83, 83′ and premovement contacts 84, 84′ contact one another by means of their facing end faces so that the electric circuit within circuit breaker 1 is closed. Switch lock 4 is closed. The toggle lever formed by the two levers 59 and 60, in this case, is in its extended position. Limiting catch 62 and catch abutment 63 prevent the toggle lever from being stretched beyond its extended position. Contact lever 12 is guided at contact lever bearing 69. The spring force of contact pressure spring 72 acts in the longitudinal direction 51 on the contact lever knob 71 of contact lever 12 by means of pressure plate 73. This causes contact lever 12, with pivot bearing 65 as rotational axis, to rotate clockwise. Contact lever end 64 of the toggle lever simultaneously presses contact lever 12 clockwise in the direction of connecting pin 70, 70', with contact lever bearing 69 as rotational axis. This results in sufficient contact pressure on main contacts 83, 83' as well as on premovement contacts 84, 84'. The position of indicator lever 76 depends on the position of contact pressure spring 72. Both components are connected to one another by way of pivoting point 77. During a movement of the contact pressure spring 72 in the longitudinal direction 51, indicator arm 79 pivots about pin 78 as the rotational axis. Depending on the position of the contact pressure spring 72 and thus of contact lever 12, a predetermined partial region of the indicator surface 80 can be seen in a viewing window 119. Viewing window 119 thus indicates whether the circuit is open or closed.

In FIG. 6 drive lever 11 is in its turn-on position. Due to the holding power of switch drive 3, it is kept in its turn-on position. The direction of magnetic flux within the switch drive 3 is directed in such a way that the end face of armature 23 contacts the truncated cone of pot cover 27. In order to improve the holding power of switch drive 3, a rotating spring 120 is additionally provided. It is fixed to a pin 121, which is fixed to the housing and extends in depth direction 44. One of the spring legs is supported by a cam 122 of drive lever 11. Cam 122 is shaped to the end of the drive lever 11 that faces away from latch lever 13. The second spring leg also contacts a housing pin 123 which is also fixed to the housing and extends in depth direction 44. The force of rotation spring 120 acts in the same direction as the magnetic force of switch drive 3 in the turn-on position of drive lever 11. During the transfer of contact lever 12 into its turn-off position (FIG. 7), the magnetic force must counteract the pressure of rotation spring 120. However, in this case, the force required by switch lock 4 is small. In FIG. 6 latch plate 54 rests in latch notch 55. As a result, drive lever 11 and latch lever 13 are latched to one another. This ensures a stable extended position of the toggle lever and the dependable retention of contact lever 12 in its contact position.

In FIG. 7 drive lever 11 is in its turn-off position. To accomplish this, the polarity of the magnetic field of coils 34, 34' is changed, based on the conditions shown in FIG. 6. As a result, coils 34, 34' receive a current pulse of approximately 30 ms. Armature 23 then moves in axial direction 24 to truncated cone 46' of pot bottom 26, and subsequent to the current pulse, it is held in its new switch position only by the force of the permanent magnet 22. Drive lever 11 is thus rotated counterclockwise with drive lever axis 52 as rotational axis and is moved into its turn-off position. With drive lever 11 in the turn-off position, a pressure arm 124 shaped to drive lever 11 charges booster switch 7 with pressure. During the movement into its turnoff position, drive lever 11 remains latched with latch lever 13. The toggle lever is moved into its bent position. Under the pressure of contact pressure spring 72, contact lever 12, with contact lever bearing 69 as rotational axis, is rotated counterclockwise and moved into its turn-off position. A disengagement of drive lever 11 and latch lever 13 is not possible, because the latch lever is rotated clockwise by means of a non-illustrated rotation spring about the axis of toggle lever 56 in such a way that it pressure charges latch end 53 of drive lever 11. The non-illustrated rotation spring, is mounted on toggle lever axis 56. Further, latch lever 13 with its surface facing contact lever 12, contacts catch abutment 63, and with the end of its switch arm 58 it contacts auxiliary switch 6 which is stationary. A counterclockwise rotation of latch lever 13 about the axis of toggle lever 56 is consequently made additionally more difficult. Latch lever 13 dependably remains in its position parallel to transverse direction 50. In the turn-off position of drive lever 11, the end of switch arm 58 facing the auxiliary switch 6, pressure charges a switch knob 125 of auxiliary switch 6.

FIG. 8 shows the relationships of the mechanism of circuit breaker 1 subsequent to the release of the bimetal. Bimetal 5 with its bimetal projection 101 passes through a slider 126 mounted on the housing parallel to transverse direction 50 in the region of its driving end. The driving end of the slider 126 opposite the transverse direction 50 is penetrated by an actuating arm 127 of an angled lever 128. The angled lever 128 comprises essentially a drive arm 127 and an unlatching arm 129 arranged perpendicular to it and extending approximately in transverse direction 50. The angled lever 128 and a circular extension of the unlatching arm 129 are mounted to rotate about an angled lever axis 130 in the region of the point of intersection points of the two arms 127, 129. Angled lever 128 is rotated clockwise by means of a non-illustrated spring. As a result, the slider 126 is moved by means of the drive arm 127 in the direction of the auxiliary switch 6.

Drive lever 127 and bimetal projection 101 of bimetal 5 rest in respective recesses of slider 126. Bimetal projection 101, depending on the adjustment point and ambient temperature, has a different position inside its associated recess in slider 126. In order not to actuate slider 126 involuntarily on account of changed ambient temperatures, the drive arm 127 of angled lever 128 may be made, for example, of a compensation bimetal.

Based on the operating positions of the mechanism in circuit breaker 1 in FIG. 6, bimetal projection 101, in case of overload, is deflected in the direction of shunt current path 97. Slider 126 is actuated in the same direction. As a result angled lever 128 is rotated counterclockwise about the angled lever axis 130. Unlatching arm 129 of the angled lever 128 strikes the surface of switch arm 58 facing it and pressure charges latch lever 13 in this region. Latch lever 13 is rotated counterclockwise about toggle lever axis 56. Latch plate 54 and latch notch 55 disengage, resulting in an unlatching of drive lever 11 and latch lever 13. Drive lever 11 in this case remains in its turn-on position. Due to the unlatching, latch lever 13 in FIG. 8, performs the same movement in the direction of switch knob 125 as during the movement of drive lever 11 from its turn-on position (FIG. 6) to its turn-off position (FIG. 7). The movement of the contact lever 12 into its turn-off position during the free release by bimetal 5 subsequent to the unlatching of drive lever 11 and latch lever 13 corresponds to the explanations in FIG. 7.

Sensors may also be used instead of bimetal 5 in order to switch circuit breaker 1 from its turn-on position to its turn-off position. The sensor is electrically connected in parallel with auxiliary switch 6 and activates the switching function if predetermined values are exceeded or not met. These types of sensors may be, for example, temperature sensors, pressure gauges, acceleration sensors, tachometers or Hall probes.

The connecting site between switch lock 4 and electromagnetic switch drive 3 is explained by way of FIG. 13. The end of switching rod 25 facing drive lever 11 is provided with rod thread 42. Rod thread 42 engages an interior thread 131 of coupling member 43. Interior thread 131 penetrates base plate 132 centrally in longitudinal direction 50. Base plate 132 is square seen in transverse direction 50. In the final mounted state, the base plate 132 is arranged perpendicular to the longitudinal extent of the switch rod 25. Base plate 132 is a component of coupling member 43. On each of the two outer edges of base plate 132 extending in longitudinal direction 51, a portion of coupling member 43 is shaped on, extending perpendicular to base plate 132 and in transverse direction 50. In the direction of the drive lever 11, these portions are formed conically, and in the region of the cone tip they are rounded approximately in the shape of a semi-circle. Each of these portions are penetrated in depth direction 44 by a coupling bore 123, 133'.

In the final mounted state, the regions of the coupling member and coupling bores 133, 133' flank drive lever 11. In this region, the drive lever 11 is provided with a coupling axis opening 134. Coupling bores 133, 133' and coupling axis opening 134 in the final mounted state are penetrated by coupling axis 40. The diameter of the coupling bores 133, 133' is smaller than that of coupling axis 134. On account of this difference, tolerances which occur during the operation of circuit breaker 1 are compensated. In the final mounted state, axis 40 also penetrates two intermediate lever bores 135, 135' of intermediate lever 136. Intermediate bores 135, 135' penetrate associated flanking components 137, 137'.

Flanking components 137, 137' arranged parallel to one another are components of intermediate lever 136. In longitudinal direction 51 they are configured conically with an approximately semicircular cone tip facing cam 122 of drive lever 11. In the final mounted state, flanking components 137, 137' on the exterior flank the regions of coupling bores 133, 133' of coupling member 43. Flanking component 137 is additionally provided with a bearing bore 138. The respective bore in flanking component 137' is not shown in FIG. 13. In the final mounted state an intermediate lever axis 139 passes through bearing bore 138 of flanking component 137 and the corresponding bore of flanking component 137' as well as through the intermediate lever bearing 140. Intermediate lever bearing 140 penetrates drive lever 11 and conforms to the outline of intermediate lever axis 139. Flanking components 137, 137' contact drive lever 11 on the exterior in the region of its intermediate lever bearing 140. As a result, intermediate lever 136 in its mounted state is mounted on drive lever 11. Flanking components 137, 137' are connected with one another by way of a base component 141 which is arranged perpendicular to them. Base component 141 has the form of a square in transverse direction 50 and has a central leg bore 142. Seen in longitudinal direction 51, base component 141 is U-shaped with a free end of the U-leg directed toward drive lever 11. The U-legs of base component 141 in part form the connecting sites between base component 141 and flanking components 137, 137'.

A compensating spring 143 is inserted in transverse direction 50 in the middle region of drive lever 11. In the final mounted state it pressure-charges the surface of base element 141 facing drive lever 11. Compensating spring 143 is so adjusted that armature 23 with its end faces facing truncate cones 46, 46' is able to be in direct contact with them. Manufacturing tolerances between switch lock 4 and switch drive 3 occurring at the beginning or during the operation of the circuit breaker 1 can be compensated by means of switch rod 25. To this end, a screwdriver, for example, engages in the adjustment slot 40 of switch rod 25. Switch rod 25, coupling member 43, intermediate lever 136, compensating spring 143, rotation spring 120, and drive lever 11 interact in such a way that play between drive lever 11 and latch lever 13 is compensated to ensure reliable latching and unlatching of these two components. Additionally, due to rotation of the switch rod 25, the air gap between armature 23 and truncated cone 46 and truncated cone 46', respectively can be kept constantly small in order to obtain a constant magnetic force.

In the final mounted state, the leg of rotation spring 120 supported by housing pin 123 passes through compensation spring 143 and leg bore 142 (FIG. 6).

Cam 122 limits the longitudinal extent of drive lever 11 at its end (FIG. 6) facing away from latch lever 13 (FIG. 6). Cam 122 has a circular outline in depth direction 44 with a semi-circular extension on part of the periphery. Deviating from the circular outline, cam 122 is flattened approximately in transverse direction 50 at the outermost longitudinal extent of drive lever 11. A bore passes through the cam 122 in depth direction 44. A common shaft may be inserted in the cams 108 of a plurality of drive levers 11 so that mechanical coupling of a plurality of circuit breakers 1 is obtained. Cam 122 is configured wider in depth direction 44 than the adjoining region of drive lever 11.

The surface of this region of the drive lever 11 facing the switch rod 25 is recessed in longitudinal direction 51. Viewed in the transverse direction 50, this recess 144 is U-shaped. As a result, drive lever 11 is not hampered during its rotational movement by switch rod 25. A region which broadens in depth direction 44 follows the region of the drive lever 11 provided with recess 144. Compensating spring 143 is inserted into this region. Drive lever 11 is mounted to the drive lever axis 52 which is fixed to the housing by means of an axial bore 145 in the lever. In this region, the structural height of drive lever 11 in transverse direction 50 is enlarged in relation to the end of drive lever 11 on the side of the cam. Pressure arm 124 is shaped in one piece in the region of the lever axis bore 145. The pressure arm is arranged with its end facing drive lever 11 in depth direction 44 and is bent perpendicularly in the direction of its free end extending approximately in longitudinal direction 51. The free end of pressure arm 124 is widened in transverse direction 50 compared to the remaining region of pressure arm 124. The surface of the free end of pressure arm 124 facing the booster switch 7 is rounded approximately into a semi-circle, with the convex side facing booster switch 7.

Adjoining the region of the lever axis bore 145 is the arm of drive lever 11 that faces latch lever 13, with its structural height decreased in transverse direction 50. This arm is offset in depth direction 44 in relation to the exterior surface of drive lever 11 carrying pressure arm 124. In this direction its width is approximately half as wide as the length of the lever axis bore 145. A lever groove 146 extending in longitudinal direction 51 is shaped into the end face of drive lever 11 facing latch lever 13. The width of the groove in depth direction 44 matches the respective width of latch lever 13 in the region of its latch notch 55. Directly adjacent to lever groove 146, drive lever 11 is penetrated in transverse direction 50 by a lever bore 147. A screw, for example, can be inserted into lever bore 147 in order to connect latch plate 54 with drive lever 11 (FIG. 6).

FIG. 14 shows that the circuit breaker housing is put together from the housing shell which acts as the housing bottom 49 and a further housing shell which acts as housing cover 148. In the region of its narrow sides, housing bottom 49 and housing cover 148 are firmly connected with a fastening plate 149 that is parallel to the narrow sides. Fastening plate 149 projects over the narrow side of both housing shells in transverse direction 50. In this projecting region, fastening plate 149 is provided with a fastening bore 150. The extent of fastening plate 149 is limited in transverse direction 50 by the edge 151 of a fastening plate. The edge 151 of the fastening plate is arranged to extend in depth direction 44. It extends to approximately one-half of the extent of circuit breaker 1 in depth direction 44. Adjacent to this is a region of the fastening plate 149 of decreased structural height in transverse direction 50. The structural height of fastening plate 149 decreases continuously in depth direction 44 until it corresponds to the structural height of circuit breaker 1 in transverse direction 50. Except for the projecting region, the extent of fastening plate 149 in depth direction 44 corresponds to the extent of circuit breaker 1 in depth direction 44.

Housing cover 148 contains a cover plate 152 arranged parallel to the plane defined by transverse direction 50 and longitudinal direction 51. Its outline is approximately square. It can be removed from the housing cover 148 by means of non-illustrated fastening means. These fastening means engage in four plate bores 153 arranged on cover plate 152. Cover plate 152 covers the electronic control unit 2 fixed inside circuit breaker 1. Electronic control unit 2 is connected to connector block 21 by means of connecting lines 16 (FIG. 15). Connector block 21 is arranged on the narrow side of the housing cover 148 facing away from fastening plate 149. In longitudinal direction 51, connector block 21 projects over housing cover 148. Connector block 21 has a rectangular outline and it contains on its surface ten connector sockets 20. The connector sockets 20 arranged next to one another in depth direction 44 are each electrically connected in parallel. Connected to the connector sockets 20 are, for example, measuring or indicator devices. A plurality of circuit breakers may also be connected in parallel.

Connector block 21 is inserted in a recess of housing cover 148. In the region of connector block 21 cover plate 152 is extended in longitudinal direction 51 in order to completely cover the recess. The viewing window 119 is arranged on the narrow side of the housing cover 148 which carries connector block 21. In the rectangular viewing window 119 it is optically indicated whether the electric circuit is open or closed. A recess on the narrow side of the housing cover 148 in the region of the viewing window 119 is also covered by an extension of cover plate 152 in the longitudinal direction 51. The cylindrical connecting pins 70, 70' extending in longitudinal direction 51 pass through the circuit breaker housing in the region of its narrow side facing away from fastening plate 149. Both connecting pins 70, 70' extend approximately in the dividing plane between housing base 49 and housing cover 148. An electric load is connected to the two connecting pins 70, 70' by way of current leads. The connecting pins 70, 70' are shielded against one another by means of a separating wall 154 which is shaped to the housing base 49. The separating wall 154 viewed in the longitudinal direction 51 is T-shaped. The transverse web of the T is arranged in transverse direction 50 and corresponds to the extent of housing base 49 in this direction. The transverse web of the T forms an extension of housing base 49 in the longitudinal direction 51, with the transverse web of the T being offset in depth direction 44 in relation to housing base 49. The extent of the circuit breaker housing in transverse direction 50 is divided into two halves by the vertical leg of the T which projects perpendicularly from the transverse web of the T. The vertical leg forms a plane arranged vertically on the circuit breaker housing. Its extent in depth direction 44 is somewhat greater than the corresponding extension of housing base 49.

FIG. 15 shows the single-pole circuit breaker 1, but with the cover plate 152 removed. A circuit board 155 is fitted into the interior region which can be closed by cover plate 152. The circuit board is arranged parallel to the plane defined by transverse direction 50 and longitudinal direction 51. The entire electronic control unit 2 is located on circuit board 155. A part of electronic control unit 2 is a hybrid circuit 156. The connections for booster switch 7 and auxiliary switch 6 are also located on the circuit board. Five connecting lines 16 connect electronic control unit 2 with connector sockets 20 of the connector block 21. Pairs of connector sockets 20 arranged next to one another in depth direction 44 are each connected in parallel. This makes possible the electric coupling of a plurality of circuit breakers 1. However, the coupling of a plurality of circuit breakers 1 can also be effected by means of direct connections to the circuit boards 155. To this end, housing base 49 and housing cover 148 are provided with non-illustrated openings so that the conductor paths on the circuit boards 155 of a plurality of circuit breakers relating to the same electric signal can be electrically connected in parallel by way of connecting wires. Except for one single connector block 21 for connecting, for example, the external remote control switch 8, the other connector blocks 21 are superfluous in this case.

Housing cover 148 is provided with four housing cover bores 157 which correspond to the plate bores 153 of cover plate 152. In the region of the electromagnetic switch drive 3 on the end face of the housing base 49 facing the housing cover 148, a groove-like adjustment opening 158 is shaped in. Through this adjustment opening 158 it is possible, for example, for a screwdriver to engage in the adjustment slot 34 of switch rod 25 in order to adjust drive lever 11 and armature 23.

FIG. 16 shows the configuration of a three-pole circuit breaker. It is constructed of three single-pole circuit breakers 1. All single-pole circuit breakers 1 are constructed the same way. The single-pole circuit beakers 1 are electrically or mechanically coupled with one another. The cams 122 of drive levers 11 may be penetrated by one common coupling rod. In this case, if the transmission of force to the activating lever 11 is sufficient, the electromagnetic switch drives 17 of the two exterior circuit breakers 1 can be dispensed with. The coupling rod passing through the cams 122 of drive levers 11 create a mechanical coupling of all circuit breakers 1. Tripping of circuit breaker 1 effects simultaneous tripping of the remaining circuit breakers 1. The inputs and outputs of a plurality of single-pole circuit breakers 1 can be connected in parallel by way of connector blocks 21. With this electrical coupling, tripping of a single-pole circuit breaker 1 by electronic control unit 2 also results in tripping of all remaining single-pole circuit breakers 1.

FIG. 17 shows schematically the electric coupling of three single-pole circuit breakers 1 into a three-pole or three-phase circuit breaker. The connections designated "A1" and "A2" correspond to connecting pins 70, 70'. Mains lines and the electrical load are connected to these connecting pins 70, 70'. In the electric coupling, a parallel input 159 designated "*1a*" is electrically connected with the input 15 of each of the two other circuit breakers 1. FIG. 3 shows that the input 15 and parallel input 159 are connected in parallel. An output 160 designated "2" is also connected in parallel with a parallel output 161 designated "*2a*" (FIG. 3). Output 160 is connected to a connecting line 16 (FIG. 15). It is additionally connected to ground. The comments made in regard to parallel input 159 and inputs 15 analogously apply to the parallel connection of the parallel output 161 of a circuit breaker 1 with the outputs 160 of the other circuit breakers. On account of the electric coupling, it is sufficient to use a single external remote control switch 8 and a single status indicator 19. Because of the parallel connection, the electrical signals at the input 15 of one circuit breaker 1 are also fed to all the other circuit breakers 1.

We claim:

1. A remotely controllable circuit breaker comprising:

a remote-control switch;

an electronic control unit coupled to the remote-control switch;

an electromagnetic switch drive, controlled by the electronic control unit, for switching an electric circuit;

a switch lock for latching the electromagnetic switch drive in a first switching position when the electric circuit is closed;

a bi-metal, coupled to the electric circuit, for providing a bi-metal release of the electromagnetic switch drive by unlatching the switch lock from the electromagnetic switch drive in response to an overcurrent condition of the electric circuit so that the electric circuit is interrupted; and an auxiliary switch, actuated by the switch lock in response to the bi-metal release, for providing a signal to the electronic control unit for turning off the remote control switch and for re-latching the electromagnetic switch drive by the switch lock in a second switching position of the electromagnetic switch drive.

2. A remotely controllable circuit breaker according to claim 1, wherein the electromagnetic switch drive moves into the second switching position in response to the remote control switch when the remote control switch is turned off.

3. A remotely controllable circuit breaker according to claim 2, wherein the switch lock re-latches the electromagnetic switch drive when the electromagnetic switch drive moves to the second switching position in response to the remote control switch when the remote control switch is turned off.

4. A remotely controllable circuit breaker according to claim 1, further comprising a booster switch for indicating a switching position of the electromagnetic switch drive.

5. A remotely controllable circuit breaker according to claim 4, wherein when the booster switch indicates that the electromagnetic switch drive is in the second switching position, the electromagnetic switch drive is enabled to be moved to the first switching position in response to a control signal from the electronic control unit.

6. A remotely controllable circuit breaker according to claim 1, further comprising:

a contact lever, pivotable between a first and a second switching position for switching the electric circuit;

a contact compression spring for applying a force to the contact lever;

a toggle lever forming a component of the switch lock and having a toggle joint, a first end and a second end, the first end being coupled to a housing of the remotely controllable circuit breaker and the second end being coupled to the contact lever, the toggle lever having a lock position for holding the contact lever in the first switching position of the contact lever by opposing the force of the compression spring and a release position for releasing the contact lever to the second switching position of the contact lever;

a latch lever, coupled to the toggle joint and latchable to the electromagnetic switch drive, for displacing the toggle joint and moving the toggle lever between the lock position and the release position of the toggle lever, the latch lever actuating the auxiliary switch when the toggle lever is in the release position.

7. A remotely controllable circuit breaker according to claim 6, wherein the latch lever includes a latch arm for latching the electromagnetic switch drive and a switch arm for actuating the auxiliary switch

8. A remotely controllable circuit breaker according to claim 7, wherein the switch arm is configured as a stop member.

9. A remotely controllable circuit breaker according to claim 6, wherein the latch lever pivots around an axis of the toggle level joint and unlatches the electromagnetic switch drive in response to the overcurrent condition detected by the bimetal.

10. A remotely controllable circuit breaker according to claim 7, wherein the electromagnetic switch drive includes a switching rod slidable between the first and second position of the electromagnetic switch drive; and a drive lever coupled to the switching rod and to the latch arm of the latch lever.

11. A remotely controllable circuit breaker according to claim 10, wherein the drive lever has a first end and a second end and is mounted to the housing and pivotable around a drive lever axis, the drive lever axis being parallel to the axis of the toggle lever, the first end of the drive lever being coupled to the switching rod, and the second end of the drive lever being latchable to the latch arm.

12. A remotely controllable circuit breaker according to claim 11, wherein the second end of the drive lever rests in a latch notch of the latch arm of the latch lever.

13. A remotely controllable circuit breaker according to claim 11, wherein the drive lever further includes a pressure arm; and wherein when the electromagnetic switch drive is in the second position, the pressure arm of the drive lever actuates the booster switch.

14. A remotely controllable circuit breaker according to claim 6, further comprising;

a viewing window in the housing; and an indicator lever having a first arm and a second arm, the first arm being coupled to the contact compression spring, the indicator lever pivoting between a first and second position for indicating the lock and the release positions of the switch lock, respectively, as a function of the a compressed size of the compression spring, the second arm being viewable through the viewing window when the indicator lever is in the second position.

15. A remotely controllable circuit breaker according to claim 10, wherein the switching rod, the latch lever, and the contact lever are arranged approximately parallel to one another;

the drive lever and the toggle lever are each arranged approximately at a right angle to the switching rod, the latch lever and the contact lever; and a plane defined by the switching rod, the latch lever, the contact lever, the drive lever and the toggle lever is a movement plane of the switching rod, the latch lever, the contact lever, the drive lever and the toggle lever.

16. A remotely controllable circuit breaker according to claim 1, further comprising a sensor, connected electrically in parallel with the auxiliary switch, for providing a trip-free release of the electromagnetic switch drive in response to an overcurrent condition of the electric circuit.

17. A remotely controllable circuit breaker according to claim 1, the electronic control unit includes a hybrid circuit.

18. A remotely controllable circuit breaker according to claim 1, wherein the electronic control unit is coupled to a connector block with a plurality of connecting lines, and wherein the connector is fastened to the housing.

19. A remotely controllable circuit breaker according to claim 18, wherein the connecting lines couple the connector block to a status indicator.

20. A remotely controllable circuit breaker according to claim 19, wherein the status indicator is a microswitch and is switched together with the auxiliary switch by the latch lever.

21. A remotely controllable circuit breaker according to claim 18, wherein the connector block includes a plurality of connector sockets which are each connected to a respective connecting line, and wherein the remote control switch is coupled to the electronic control unit through the connector block, and an external indicator device is coupled to the status indicator through the connector block.

22. A remotely controllable circuit breaker according to claim 21, wherein the connector sockets are coupled to connector sockets of at least one additional remotely controllable circuit breaker forming a multi-pole circuit breaker.

23. A remotely controllable circuit breaker according to claim 1, wherein an input and an output of a circuit board of the electronic control unit are connected to an input and an output of an electronic control unit of another remotely controllable circuit breaker by connecting leads which traverse the housing.

24. A remotely controllable circuit breaker according to claim 1, further comprising:

two connecting pins for connecting to the electrical circuit; and a separating wall projecting from the housing and arranged between the two connecting pins, the separating wall having a lateral extension projection from the housing for insulating the connecting pins from connecting pins of adjacent circuit breakers.

25. A remotely controllable circuit breaker according to claim 1, wherein the electromagnetic switch drive includes a mechanical coupling which acts on a switch lock of another circuit breaker.

* * * * *